US011542073B2

(12) United States Patent
Schneider et al.

(10) Patent No.: US 11,542,073 B2
(45) Date of Patent: Jan. 3, 2023

(54) CHILDPROOF CONTAINER CLOSURE

(71) Applicant: Sanner GmbH, Bensheim (DE)

(72) Inventors: Matthias Schneider, Heidesheim (DE); Kai Tiesberger, Niedernhausen (DE)

(73) Assignee: Sanner GmbH

( * ) Notice: Subject to any disclaimer, the term of this patent is extended or adjusted under 35 U.S.C. 154(b) by 358 days.

(21) Appl. No.: 14/761,045

(22) PCT Filed: Jan. 15, 2014

(86) PCT No.: PCT/EP2014/000075
§ 371 (c)(1),
(2) Date: Jul. 15, 2015

(87) PCT Pub. No.: WO2014/111249
PCT Pub. Date: Jul. 24, 2014

(65) Prior Publication Data

US 2015/0344202 A1 Dec. 3, 2015

(30) Foreign Application Priority Data

Jan. 15, 2013 (DE) ..... 10 2013 000 483.7

(51) Int. Cl.
*B65D 50/04* (2006.01)
*B65D 45/16* (2006.01)
(Continued)

(52) U.S. Cl.
CPC ..... *B65D 45/16* (2013.01); *B65D 43/16* (2013.01); *B65D 47/0804* (2013.01); *B65D 50/046* (2013.01); *B65D 2215/02* (2013.01)

(58) Field of Classification Search
CPC ..... B65D 50/046; B65D 47/0804; B65D 2251/1051; B65D 2251/1033;
(Continued)

(56) References Cited

U.S. PATENT DOCUMENTS 3,623,622 A * 11/1971 Sullivan ..... B65D 55/02 215/213
3,774,794 A * 11/1973 Bateman ..... B65D 50/046 215/220
(Continued)

FOREIGN PATENT DOCUMENTS

DE 2828065 A1 * 1/1980 ..... B65D 47/0819
DE 29615425 U1 * 1/1998 ..... B65D 47/0814
(Continued)

OTHER PUBLICATIONS

DE_29615425_translation.pdf.*
(Continued)

*Primary Examiner* — Allan D Stevens
(74) *Attorney, Agent, or Firm* — Dean W Amburn; Amburn Law PLLC

(57) ABSTRACT

The invention relates to a container closure, for a container (1) having a storage space (6) for accommodating goods to be packaged, wherein said container closure comprises a section (3) situated adjacent to the container and in which a discharge opening (16) for the goods to be packaged is formed, said container closure having a lid (4) for the purpose of closing said discharge opening (16), said lid (4) being connected via a hinge (5) to said section (3) situated adjacent to the container, said container closure further comprising a child safety device (7). The invention is characterized in that the section (3) situated adjacent to the container forms a chamber (12), which is separate from the storage space (6) and that said child safety device (7) is disposed in the chamber (12) at least when the lid (4) is in a closed position.

1 Claim, 23 Drawing Sheets

(51) Int. Cl.
*B65D 43/16* (2006.01)
*B65D 47/08* (2006.01)

(58) Field of Classification Search
CPC .... B65D 2251/1058; B65D 2251/1016; B65D 45/16; B65D 45/20; B65D 2251/0087; B65D 25/40; B65D 43/22; B65D 50/045
USPC ..... 215/224, 216, 225
See application file for complete search history.

(56) References Cited

U.S. PATENT DOCUMENTS 4,022,352 A * 5/1977 Pehr ..... B65D 47/0838 222/153.14
4,127,221 A 11/1978 Vere
4,212,415 A * 7/1980 Neely ..... B65D 11/10 220/324
4,244,495 A * 1/1981 Lorscheid ..... B65D 47/0819 222/153.14
4,838,441 A 6/1989 Chernack
4,974,735 A 12/1990 Newell et al.
5,036,980 A * 8/1991 Vigue ..... B65D 21/0234 206/515
5,346,069 A * 9/1994 Intini ..... B65D 21/0233 206/531
5,549,214 A 8/1996 Harris
6,772,902 B1 * 8/2004 White ..... B65D 43/162 215/201
6,866,164 B2 3/2005 Branson et al.
7,328,820 B2 * 2/2008 Young ..... B65D 47/0838 215/235
2005/0205607 A1 * 9/2005 Hierzer ..... B65D 47/0804 222/153.1
2007/0125741 A1 6/2007 Keung
2008/0110849 A1 * 5/2008 Wachsberg ..... B65D 47/0842 215/323
2011/0297698 A1 * 12/2011 Chiang ..... B65D 47/08 222/109
2012/0211493 A1 * 8/2012 Daggett ..... B65D 43/162 220/315
2015/0283028 A1 * 10/2015 Intini ..... A61J 1/16 206/438
2018/0370698 A1 * 12/2018 Thomsen ..... B65D 47/36

FOREIGN PATENT DOCUMENTS

EP 1 357 049 A2 10/2003
GB 2 319 244 A 5/1998
WO WO 1997 048 615 A1 12/1997
WO WO 2003 095 319 A1 11/2003
WO WO 2010 068 548 A1 6/2010
WO WO 2012 152 376 A1 11/2012
WO WO-2014077844 A1 * 5/2014 ..... B65D 81/325

OTHER PUBLICATIONS

Machine-Assisted English language translation of Publication No. WO 2012 152 376 A1 extracted from www.espacenet.com on Jul. 1, 2015; 36 pages.
German National Search Report for Application No. DE 10 2013 000 483.7 dated Oct. 14, 2013; 2 pages.
International Search Report for Application No. PCT/EP2014/000075 dated Jul. 25, 2014; 6 pages.
English language abstract of European Patent Application No. EP 1 357 049 A2; See English language equivalent U.S. Pat. No. 6,866,164 B2; 2 pages.

* cited by examiner

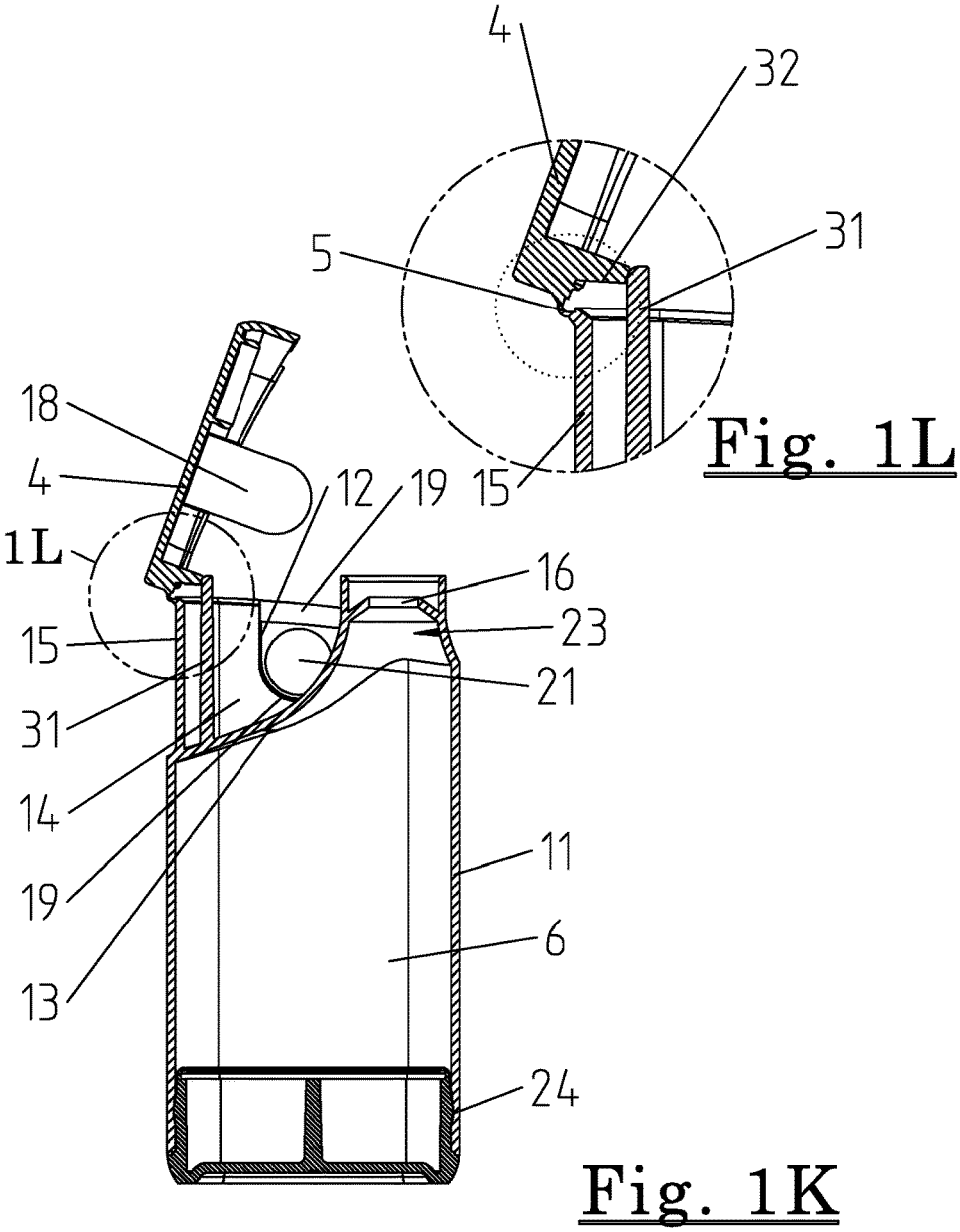
Fig. 1L
Fig. 1K
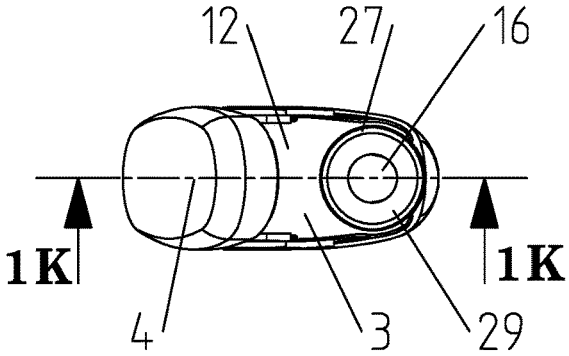
Fig. 1M

Fig. 6D
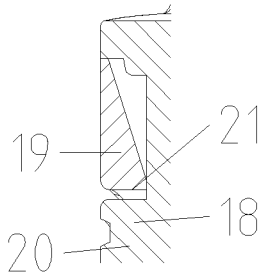
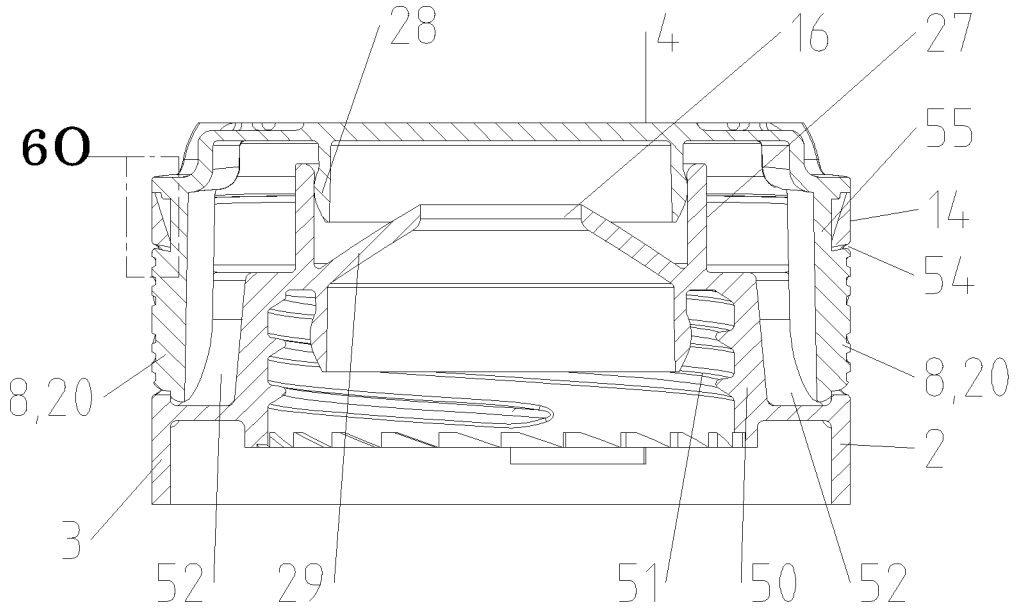
Fig. 6E
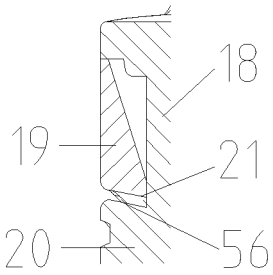
Fig. 6O

CHILDPROOF CONTAINER CLOSURE

RELATED APPLICATIONS

This application is the National Stage of International Patent Application No. PCT/EP2014/000075, filed Jan. 15, 2014, which claims priority to and all the advantages of German Patent Application No. DE 10 2013 000 483.7, filed on Jan. 15, 2013, the entire contents of which are hereby incorporated by reference.

FIELD OF THE INVENTION

The present invention relates to a container closure for a container comprising a storage space adapted to accommodate goods to be packaged, more particularly tablets, wherein the container closure comprises a section situated adjacent to the container, in which a discharge opening for the goods to be packaged is formed, wherein the container closure further comprises a lid for closing said opening, said lid being connected to the section situated adjacent to the container via a hinge, and wherein the container closure comprises a child safety device.

Said child-proof container closures are commonly used for the purpose of safeguarding goods from being accessed by children. This is of particular importance for example in the case of medicines, as the unintentional ingestion thereof by children can lead to serious health problems. Furthermore, child-proof container closures are used for other goods, for example chemical products, which must be safeguarded from access by children.

DESCRIPTION OF THE RELATED ART

Container closures comprising a section adjacent to the container and a lid hinged thereto are known. US 2007/0125741 A1 describes a so-called flip-top container provided with a child safety device. To this end, the closure comprises a latch, which is positioned in a small opening when the lid is in the closed position. The child safety device can be unlocked by applying pressure to the latch inwardly in a radial direction.

A child-proof container comprising a lid secured by way of a snap lock when the container is in the closed position is disclosed in GB 2 319 244 A. The snap lock, disposed on the side opposite the hinge, can be unlocked by applying pressure in an inward direction.

EP 1 357 049 A2 shows a child-proof dispenser. Teeth are provided on the side of the lid for the purpose of locking the lid, said teeth being capable of engaging the shoulders provided on the section situated adjacent to the container.

U.S. Pat. No. 4,974,735 describes a container closure, the lid of which comprises locking arms adapted to engage slots provided on the section situated adjacent to the container. The closures of the prior art suffer from the disadvantage that handling thereof is not as easy as would be desired. The difficulty herein lies in the fact that said child-proof closures are to be designed such that they cannot be opened by small children, while at the same time adults should be able to open said closures easily and as intuitively as possible. Consideration is to be given, especially in the case of medicinal container closures, to the fact that these should also be suitable for use, in particular, by the elderly and the sick, who in some circumstances have reduced mobility of the fingers.

It is thus an object of the present invention to provide a child-proof container closure that is easy to use and the production of which is simple and inexpensive.

SUMMARY OF THE INVENTION

For a container closure of the type described above said object is achieved in that the section situated adjacent to the container forms a chamber that is separate from the storage space and the child safety device is disposed within the chamber, at least when the lid is in a closed position. The section may further comprise a discharge chute, separated from the chamber by a partition wall. The discharge chute is in communication with the storage space. The discharge chute includes within it a discharge opening for the goods to be packaged in the container. A seal is formed between a protruding seal on the lid and a tubular part on the section when the lid is closed. The chamber includes a child safety device.

Such an arrangement facilitates the operation of the lid in a particularly simple manner. The components of the child safety device can be manufactured with the desired dimensions on account of the configuration involving a chamber separate from the storage space in the section situated adjacent to the container. In this way, elderly and/or sick persons having reduced finger mobility are also able to operate the child safety device without incurring problems. In this regard, the chamber can accommodate the child safety device, either in its entirety or only in part. Furthermore, the container closure can be produced cheaply. The container closure can for example be in the form of a plastics injection-molded part that can be produced in large quantities at low expense. Another advantage of the configuration of the invention is the fact that the height of the container closure can be kept to a minimum. This makes for an optically attractive design of the container closure. A unit incorporating a container closure of the invention is suitable for both solid and liquid contents. It is particularly suitable for piece goods such as tablets, capsules, and the like. Preferably medicines can be stored in this manner.

In one advantageous configuration, provision is made for the child safety device to comprise a clamping element pertaining to the lid and forming a form-fit with a corresponding clamping element pertaining to the chamber. The child safety device can thus reliably prevent undesired opening of the container closure. In particular, a side wall of the chamber may form the clamping element pertaining to the chamber. The clamping element on the lid may be in the form of a clamping flap, for example. There may be a distance between the clamping flap and the hinge. Preferably, a clamping element pertaining to the lid and a clamping element pertaining to the chamber are each provided on two opposite sides of the container closure.

A further improvement on operability is achieved when the child safety device comprises an actuating section for the purpose of unlocking the clamping elements. The actuating section may be in the form of an actuating button. Two actuating sections are preferably provided, disposed on opposite sides of the container closure. The child safety device can be unlocked by simultaneously actuating said actuating sections (preferably by applying pressure inwardly). Provision may be made for each actuating section to be assigned to one clamping element.

Furthermore, provision may preferably be made for the actuating section to comprise a protruding edge, said protruding edge interlocking positively with the clamping element pertaining to the chamber, thus forming a hindrance to unlocking of the child safety device. This makes for ease of operation while improving the safety aspect of the child safety device. Especially when the lid is pushed away from the section adjacent to the container without unlocking the child safety device, the form fit, which hinders, in particular, inward movement of the actuating section, can impede undesired opening of the container closure. A form fit can preferably be achieved by the provision of an undercut on the clamping element pertaining to the chamber and/or on the actuating section.

According to another advantageous configuration of the actuating section, the latter is assigned to the clamping element pertaining to the chamber, which clamping element pertaining to the chamber can be moved to a release position by applying pressure to the actuating section for the purpose of unlocking the child safety device. Such a configuration again results in easy, intuitive operability without the container closure being openable by small children in an undesired manner.

Ease of operation is achieved, in particular, when an opening is provided in the clamping element pertaining to the chamber, with which a projection provided on the clamping element pertaining to the lid interlocks, and/or when a projection is provided on the clamping element pertaining to the chamber and is adapted to engage an opening provided on the clamping element pertaining to the lid. Provision can be made for the clamping element pertaining to the lid to be accessible via the opening in the clamping element pertaining to the chamber, wherein the child safety device is being unlockable by applying pressure to the clamping element. The projection may preferably form the actuating section of the child safety device.

Operability is further improved when the opening is of a size ranging from 40 $mm^2$ to 90 $mm^2$, more particularly from 50 $mm^2$ to 80 $mm^2$. It has been found that such a configuration can provide easier handling. This is accompanied by the fact that the projection, including the thrust face, can be easily felt by hand, the opening preventing the projection from being excessively pushed in by a finger. Each projection is thus prevented from being moved inwardly to a greater extent than desired. It is advantageous when the projection comprises a thrust face of a corresponding size, that is to say, one also of from 40 $mm^2$ to 90 $mm^2$, more particularly from 50 $mm^2$ to 80 $mm^2$. More particularly, the projection may be in the form of a button. The projection and the opening preferably have a diameter of from 8 mm to 10 mm. The projection and the opening are preferably round or, more particularly, circular in shape. The thrust face may feature a decoration or a logo.

In a particularly preferred configuration, provision is made for the clamping element pertaining to the chamber to be formed by a section of a side wall of the chamber, the opening being provided in the side wall of the chamber. Two openings are preferably provided on opposite parts of the side wall (or on opposite side walls). Intuitive operability is thus further improved.

Further improvement of the operability is achieved when the side wall of the chamber has a receding region adjacent to the actuating section. In this way, the child safety device, more particularly the actuating sections thereof, can be operated in a particularly simple and intuitive manner. This makes it possible, in particular, for the actuating section or more particularly the projection, to protrude outwardly relatively to the receding region so that it can be readily grasped. This can also result in the actuating section not protruding beyond the outer contour of the side wall of the chamber or of the container wall, thus simplifying, in particular, the mechanical transport of the container closure during, for example, a filling operation.

According to the invention, it is particularly preferable for the opening and the projection to have matching contours in a region of mutual contact, said contours being round in shape, at least a section thereof. On the one hand, this makes for ease of operation. On the other hand, the forces are evenly distributed due to the round shape of the contours. It is particularly preferable for the projection and the opening to comprise a round, preferably circular basal area.

A preferred configuration makes provision for the chamber to be disposed in a region between the opening and the hinge. In such a case, the goods can be removed very easily. Ease of operation can also be achieved thereby.

A particularly advantageous configuration of the invention makes provision for the lid to comprise a protruding skirt-shaped rim, wherein the length of said skirt-shaped rim increases with its distance from the hinge. The length preferably increases continuously. The skirt-shaped rim can extend from one side of the hinge around the lid to the other side of the hinge. This causes the lid to be slanted. Differences in wall thickness in the section situated adjacent to the container can thus be advantageously obviated, which could otherwise lead to deviations in shape, for example to an out of round shape, or to sealing problems.

The operability and, more particularly, the reliable discharge of the goods to packaged, is improved when the discharge opening is formed by a tubular element, against which a projecting sealing element of said lid sealingly abuts, when the lid is in the closed position, and when a size limiting element, extending radially inwardly from the tubular part and diminishing the clear width of the opening, is provided on the tubular part. The size limiting element thereby enables adaption to the different sizes of goods, for example different sizes of tablets, without any need to manufacture a new injection mold. The clear width of the size limiting element can be adapted to the different tablet sizes or the like by way of tool inserts. Advantageously, the size limiting element extends along an inward slant.

An advantageous configuration of the invention makes provision for the section situated adjacent to the container and/or on the lid to comprise longitudinal lateral surfaces and transverse lateral surfaces, and for the longitudinal lateral surfaces to be of greater width than the transverse lateral surfaces. Such a configuration not only results in a compact and appealing design, but also makes for ease of operation. The width of the longitudinal lateral surfaces is preferably more than 1.5 times the width of the transverse lateral surfaces. The lid on the container and the container itself may for example be oval or rectangular in shape.

Furthermore, the invention relates to a container comprising a storage space adapted to accommodate goods to be packaged, the storage space being limited by a container wall, and comprising a container closure according to the invention. The container closure comprising the section situated adjacent to the container may be a separate injection-molded part, or may be integrally united with the container wall. In this case, filling can take place through an opening in the base of the container, which is sealed following the filling operation. The side wall of the chamber is preferably formed by an extension of the container wall.

An advantageous configuration makes provision for the lid and the section situated adjacent to the container to be formed as a single injection-molded plastics part. The hinge may be in the form of a film hinge. This results in the lid showing high stability. At the same time, production costs are kept down.

A particularly preferred embodiment makes provision for the section adjacent to the container to comprise a partition wall, of which a first side limits the chamber and a second side limits the storage space. Configuration of the chamber, which is separate from the storage space, can thereby be particularly convenient. At the same time, the partition wall may be configured such that discharge of the goods through the opening is particularly easy.

Further improvement is achieved by designing the section situated adjacent to the container so as to form side walls of the chamber connected to the partition wall, the side walls forming part of an outer wall of the section situated adjacent to the container. Furthermore, provision can be advantageously made for the chamber to comprise a rear wall that connects the side walls, the lid being disposed on the rear wall via the hinge. This embodiment makes it particularly easy to operate the container closure. It is particularly advantageous when the chamber is covered, at least in part, by the lid when the lid is in a closed position. In this way, the child safety device can be protected from contamination while in the closed position.

The discharge of the goods is facilitated by forming the partition wall as a glide surface which comprises an inner contour narrowing towards the opening. In this way, the glide surface may form a pouring aid. The goods can by this means be guided toward the opening. In the case of piece goods such as tablets or capsules, it may also be possible to reduce the risk of the goods becoming jammed, with the result that the tablets or capsules will be capable of being discharged individually without encountering problems. To this end, it is advantageous when the partition wall comprises, at least in part, a contour that is rotationally symmetrical about an imaginary longitudinal axis. This also leads to a reduction in production costs, since the injection mold may be machined on a lathe to provide the rotationally symmetrical contour. It is particularly advantageous when the imaginary longitudinal axis extends through the opening. The imaginary longitudinal axis preferably extends through the center of the opening and/or at right angles to the opening.

According to the invention, it is further preferable for the lid to comprise a sealing gasket, which seals the discharge of opening when the lid is in the closed position.

Further objects, features, advantages, and possible applications of the present invention emerge from the following description of exemplary embodiments with reference to the figures. In this regard, all characteristics specified and/or shown below form, alone or in any suitable combination, the subject-matter of the invention, independently of the abstract or the contents of individual claims or of their back references.

DETAILED DESCRIPTION

Figure 1A:
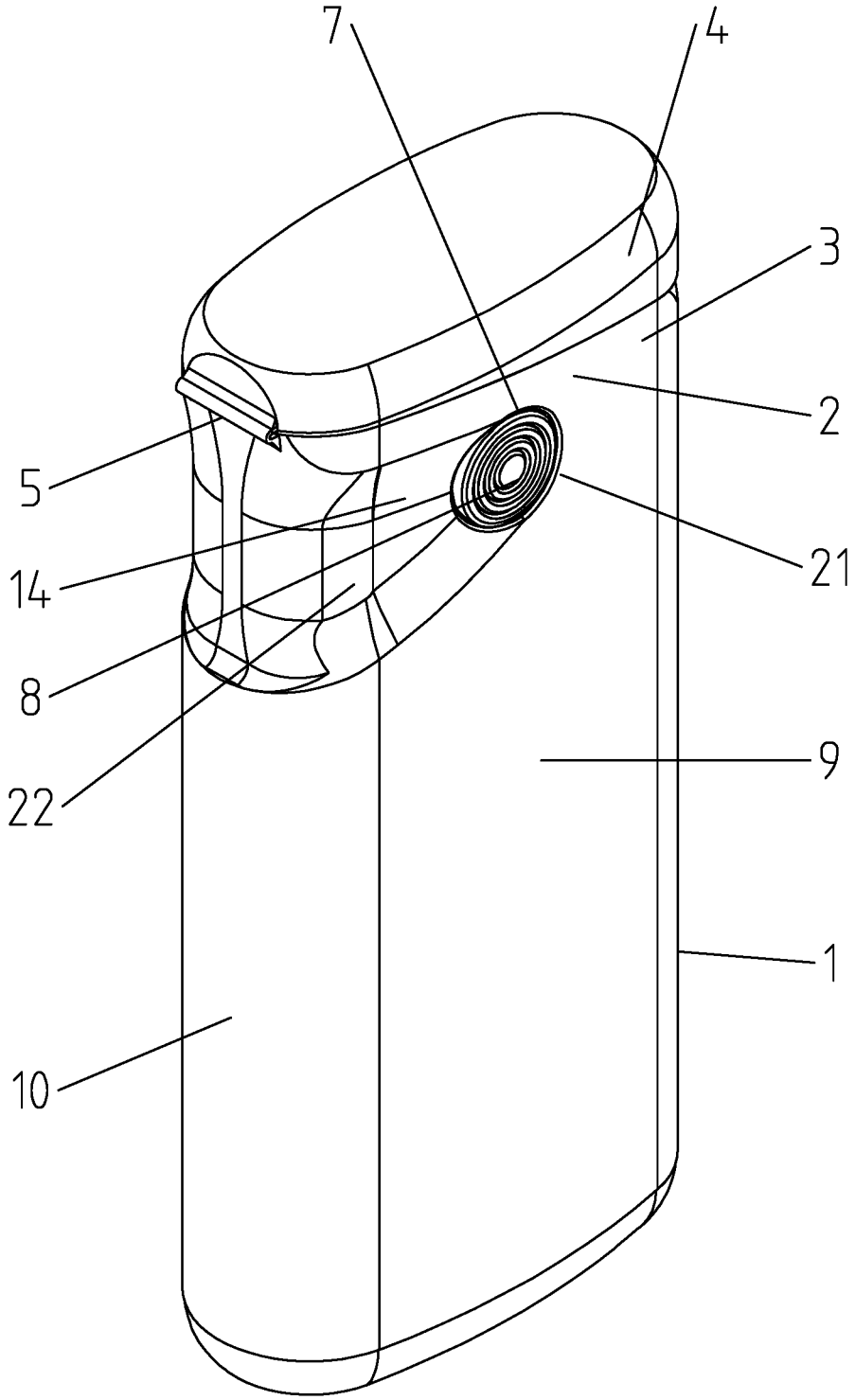
FIGS. 1A to 1N: show a first embodiment of the invention.
Figure 1F:
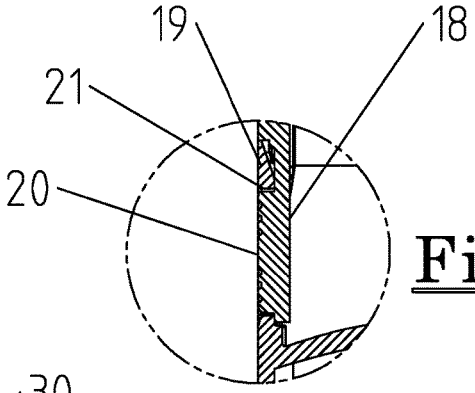
Figure 1B:
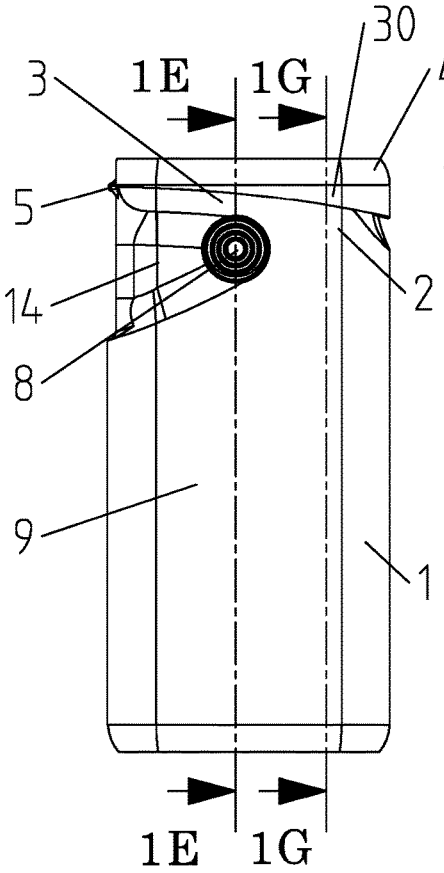
Figure 1E:
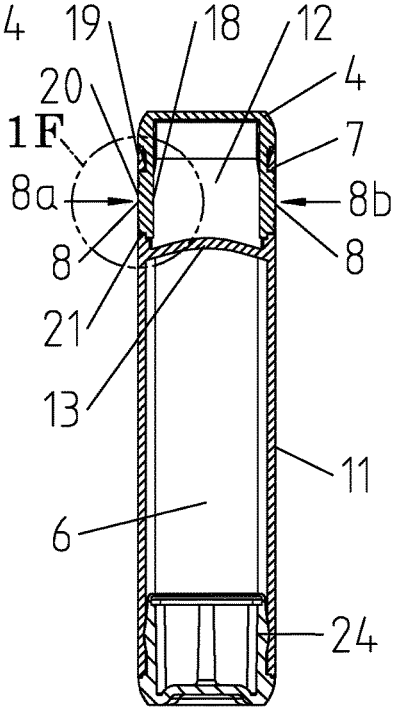
Figure 1G:
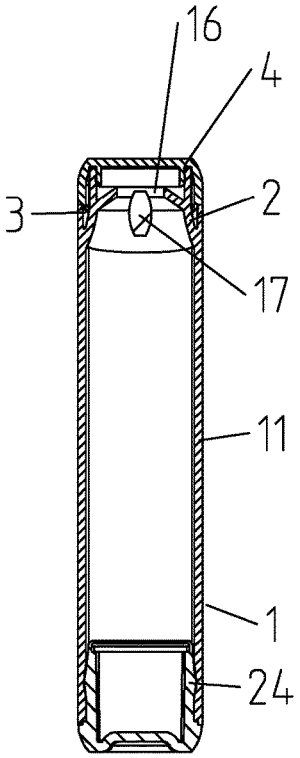
Figure 1H:
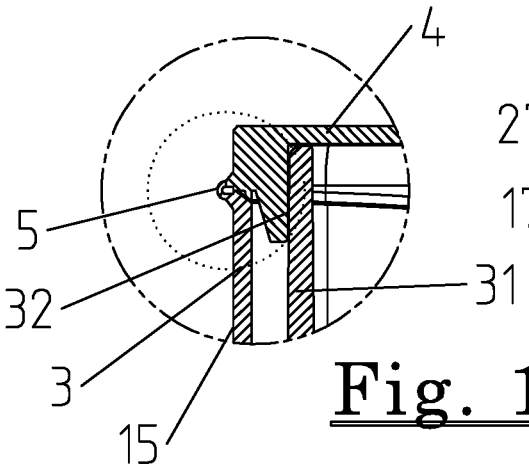
Figure 1I:
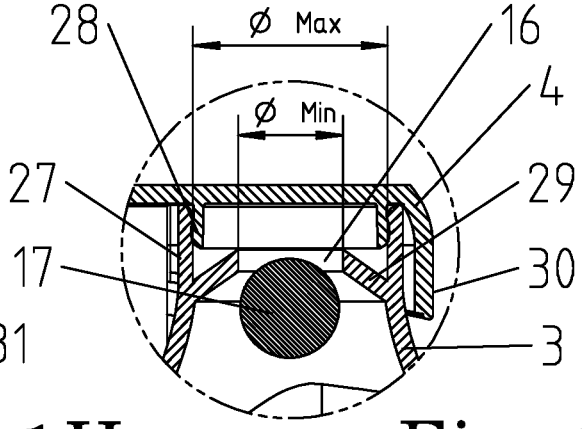
Figure 1C:
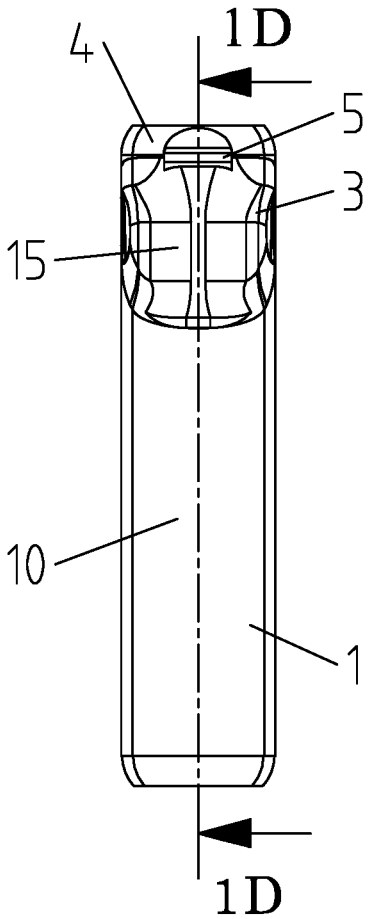
Figure 1D:
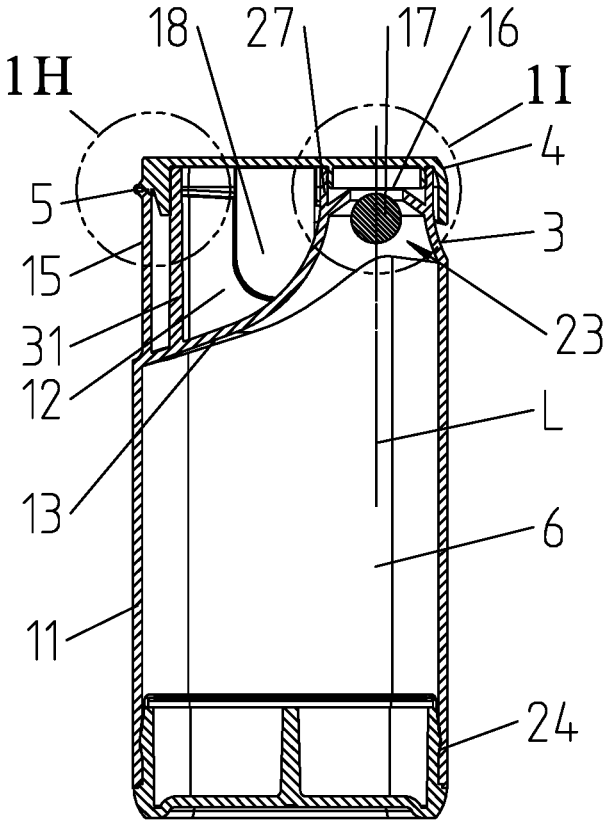
Figure 1J:
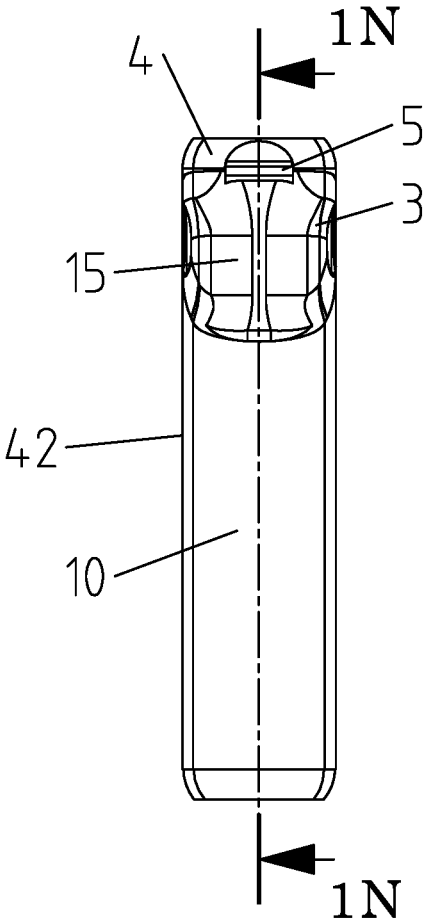
Figure 1N:
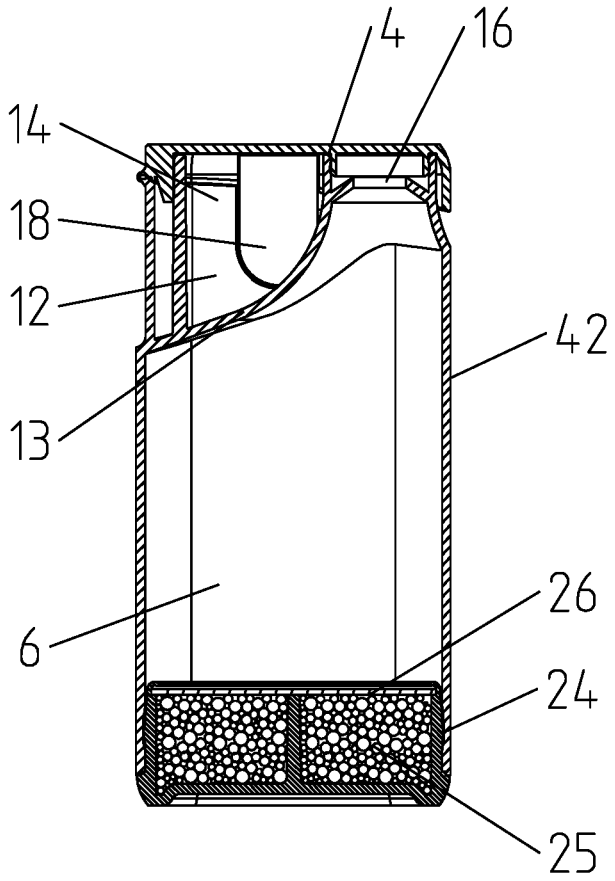

FIGS. 1A to 1N show a first embodiment of the invention. FIG. 1A is a perspective view of a container 1 comprising a container closure 2. FIGS. 1B and 1C are side views of the same container, showing its long side and its short side respectively. FIG. 1D is a longitudinal section of the container taken along the line 1D-1D in FIG. 1C. FIG. 1E is a cross section of the container taken along the line 1E-1E in FIG. 1B. FIG. 1F shows an enlarged detail 1F from FIG. 1E. FIG. 1G is a cross section of the container taken along the line 1G-1G in FIG. 1B. FIGS. 1H and 1I show enlarged details 1H and 1I from FIG. 1D. FIG. 1N is a longitudinal section of the container taken along the line 1N-1N in FIG. 1J but additionally illustrates the desiccant. FIG. 1K is a longitudinal section of the container taken along the line 1K-1K in FIG. 1M showing the lid in the open position. FIG. 1L shows an enlarged detail from FIG. 1K. FIG. 1M is a plan view of the container.

The container closure 2 comprises a section 3 adjacent to the container and a lid 4 connected to the section 3 adjacent to the container via a hinge 5. The hinge 5 is in the form of a film hinge and enables opening of the lid 4, said lid remaining hinged to the section 3 on the container via the hinge 5. The lid 4 may be in the form of a flip-top lid.

The container 1 shown encloses a storage space 6 (see FIG. 1D) adapted to accommodate goods to be packaged. The container 1 shown is particularly suitable for the accommodation of medical products, e.g. tablets or capsules. It can however also be used for other solid, or even liquid, products.

The container 1 is provided with a child safety device 7 for the purpose of preventing small children from opening it. Said device prevents undesired opening of the lid 4 from the closed position shown in FIG. 1A. FIG. 1A clearly shows the actuating section 8 of the child safety device 7.

FIG. 1A further shows the section 3 adjacent to the container and the lid 4 comprising longitudinal lateral surfaces 9 and transverse lateral surfaces 10, the longitudinal lateral surfaces 9 being of greater width than the transverse lateral surfaces 10. This results in the basic shape of the container 1 being essentially rectangular in cross section and having distinctly rounded edges.

Further figures are described below. Parts having the same function have the same reference signs even if they are of a different design. For the purpose of avoiding repetition, only selected features are explained in the figures, even if they partly relate to different embodiments. With regard to other features, reference is made to the description thereof as applied to other figures, which description is also relevant in such cases.

FIGS. 1B and 1C clearly show the section 3 adjacent to the container, the lid 4, and the actuating section 8 of the child safety device 7.

FIG. 1D shows a longitudinal section of the container 1. The storage space 6 within the container 1, which is limited by a container wall 11 is clearly visible. FIG. 1D also shows further details of the child safety device 7. The section 3 adjacent to the container 1 forms a chamber 12 that is separate from the storage space 6. To this end, the section 3 adjacent to the container 1 comprises a partition wall 13, a first (upwardly facing) side thereof limiting the chamber 12, and a second (downwardly facing) side thereof limiting the storage space 6. Furthermore, the section 3 adjacent to the container 1 forms side walls 14 of the chamber 12, which are connected to the partition wall 13 (see FIG. 1B). The side walls 14 are thus part of the outer wall of the section 3 adjacent to the container 1. The chamber 12 also comprises a rear wall 15 and opposing side walls 14. The rear wall 15 joins the opposing side walls 14, the lower section of which is connected to the partition wall 13. The section 3 further comprises a discharge chute 23, separated from the chamber 12 and at least partially defined by the downwardly facing side of partition wall 13. The discharge chute 23 is in communication with the storage space 6. The discharge chute 23 includes within it a discharge opening 16 for the goods to be packaged in the container 1. The chamber 12 includes the child safety device 7.

FIG. 1D further clearly shows the discharge opening 16. In the position shown in FIG. 1D, said opening is closed by means of the lid 4. On opening the lid 4 (see FIG. 1K), goods present in the storage space 6 can be dispensed via the discharge opening 16. For illustration purposes, FIG. 1D shows a single tablet 17 in the region of the discharge opening 16. The storage space 6 may be filled with a plurality of such tablets. FIG. 1D also clearly demonstrates that the chamber 12 is disposed in the region between the discharge opening 16 and the hinge 5.

It is further shown how the child safety device 7 interlocks with the chamber 12. To this end, the child safety device 7 comprises, in the embodiment shown, a pair of generally opposed clamping elements 18 projecting from the bottom of the lid 4, each of the clamping elements 18 is operably spaced from the other clamping element 18. Each of the clamping elements 18 on the lid 4 is in the form of a movable tongue. In the exemplary embodiment shown, the tongue is movable due to its resilience. This is demonstrated particularly well in FIGS. 1E and 1F. Furthermore, the tongues may also be movable on account of the lid 4 on which the tongues are mounted, this being resiliently deformable. Each actuating section 8 in the immediate embodiment is disposed at a distal end of the clamping elements 18.

When the lid 4 is in the closed position, the clamping elements 18 on the lid 4 project into the chamber 12. Each one of the clamping elements 18 interlock with a corresponding one of a pair of generally opposing clamping elements 19 disposed in the opposing side walls 14 of the chamber 12. Each one of the pair of opposing clamping elements 19 is disposed in one of the pair of opposing walls 14. In the embodiment shown, the clamping elements 19 disposed in the chamber 12 are formed by openings 21 in the side walls 14. The clamping elements 18 on the lid 4 comprise a projection 20 formed by a section having increased material thickness, such as a button. When the lid 4 is in the closed position, each projection 20 engages one of the pair of openings 21 of the side wall 14 and snaps into place therein. In the case of the embodiment shown in FIGS. 1A to 1N, the outer surfaces of the projection 20 form the actuating section 8. The child safety device 7 can be unlocked by simultaneously applying inward pressure to both actuating sections 8 (along the direction of arrows 8*a* and 8*b* as shown in FIG. 1E) until the projections 20 move inwardly to such an extent that the interlocking action is cancelled, while lifting the lid 4. As a rule, the clamping elements 18 on the lid are squeezed together by applying pressure to the actuating sections 8 using two fingers of one hand while the lid 4 is simultaneously lifted using one finger of the other hand. The clamping elements 18 and 19 are designed such that the child safety device 7 snaps audibly into place on closing the lid 4. This action facilitates handling and prevents the lid 4 from being only apparently safeguarded against opening. It is within the scope of the present invention that either claiming elements 18 or claiming elements 19 may be inwardly actuated to unlock the lid 4. The design of the child safety device 7 complies with and surpasses the relevant statutory requirements.

The design shown also enables the child safety device to snap audibly into place. On closing the lid 4, the clamping elements 18 on the lid are initially moved resiliently inwardly by means of the clamping elements 19 pertaining to the chamber. As soon as the projection 20 enters the area of the opening 21, the clamping elements 18 on the lid, which may, more particularly, be in the form of tongues, move outwardly again to a slight extent. In this regard, the clamping element 18 on the lid makes contact with the clamping element 19 pertaining to the chamber. Said action produces a clearly audible clicking sound, informing the operator to the effect that the lid has been closed correctly and that the child safety device is active.

The projection 20 has a thrust face of a size ranging from 40 $mm^2$ to 90 $mm^2$, preferably from 50 $mm^2$ to 80 $mm^2$. The opening 21 is of a similar size. The opening 21 is marginally larger than the projection 20 for the purpose of enabling the opening 21 to accommodate the projection 20. In the exemplary embodiment shown, the projection 20 and the opening 21 are circular and have a diameter ranging from preferably 8 mm to 10 mm. The thrust face is provided with circular grooves that can be readily detected by hand. The thrust face may also feature a logo or the like.

It is also apparent that the opening 21 and the actuating section 8 (projection 20) comprise corresponding contours in a region of mutual contact therebetween, said contours being round in shape. In the present case, the opening 21 and the projection 20 of the actuating section 8 are circular in shape.

When the lid 4 is in the closed position, the outer surface of the clamping element 18 on the lid makes contact with the inner surface of the side wall 14. The contour of the outer surface of the clamping element 18 corresponds to the contour of the inner surface of the side wall 14. The clamping element 18 and the side wall 14 have parallel contours.

FIG. 1A shows particularly clearly that the side wall 14 of the chamber 12 has a receding region 22. This region 22 is formed by an inwardly sloping part of the side wall 14. In this regard, the actuating section 8 may protrude laterally beyond the receding region 22. The actuating section 8 can thus be very easily detected by touch. It is possible, but not necessary, for the actuating section 8 to protrude laterally beyond the outer contour of the container wall 11. When the actuating section 8 does not protrude laterally beyond the outer contour of the container wall 11, the mechanical transport of the container closure, for example during filling, is easier to carry out and less problematic.

The figures further show that the side walls 14 of the chamber are formed by an extension of the container wall 11. In the exemplary embodiment shown, the side walls 14 and the container wall 11 are thus formed by a single continuous wall. The partition wall 13 separates the side walls 14 of the chamber from the container wall 11.

In the embodiment shown, the partition wall 13 forms a glide surface adapted to guide the goods toward the discharge opening 16 during discharge thereof. The partition wall 13 is designed so as to form an inner contour narrowing towards the discharge opening 16. In this way, dispensing of individual tablets, capsules, or the like is facilitated with the result that the risk of said items becoming jammed near the discharge opening 16 is reduced. This is shown particularly clearly in FIG. 1D. To this end, the partition wall 13 comprises a contour that is rotationally symmetrical about an imaginary longitudinal axis L. In this way, a contour is formed in the region below the discharge opening 16 that is at least in part rotationally symmetrical. This simplifies the manufacture of the injection mold. In the exemplary embodiment shown, the imaginary longitudinal axis L extends centrally through the discharge opening 16 in a direction at right angles to the opening plane of the discharge opening 16.

FIGS. 1D, 1E, and 1G clearly show that the container 1 is formed as a single injection-molded part including the container wall 11 and the container closure 2. The storage space 6 may be filled through an opening located at the bottom of the container wall 11. The container is sealed by means of an independently manufactured base plug 24. FIGS. 1D, 1E, and 1G show the base plug 24 without desiccant. However, the base plug 24 may be filled with a desiccant, for example a silica gel or molecular sieve. The goods can thus be stored in a defined, dry atmosphere. In a desiccant containing embodiment of the container 42, FIG. 1N shows a base plug filled with the desiccant 25. The desiccant 25 is retained in the base plug by means of a vapour permeable cover plate 26.

In the closed position, the lid 4 locks and seals the storage space. To this end, provision is made in the exemplary embodiment for the discharge opening 16 to be formed by a tubular part 27. The lid 4 comprises a protruding sealing part 28 in sealing contact with the tubular part while the lid 4 is in the closed position. FIG. 1I shows this particularly clearly. The sealing part 28 is in the form of an annular wall. A size limiting element 29 is also provided on the tubular part 27, extending radially inwardly from the tubular part 27. In the case of the embodiment shown, the size limiting element 29 is of an annular shape and is disposed at a slant relatively to the imaginary longitudinal axis L. The size limiting element 29 enables the clear width of the discharge opening 16 to be adjusted to the respective goods to be packaged 17. There is therefore no need to fabricate a new injection mold. Instead, a number of different inserts can be provided to fit one injection mold for the purpose of adjusting the inward extent of the size limiting element and thus the clear width of the discharge opening 16. The clear width of the discharge opening 16 can be adjusted between Ø Min and Ø Max (see FIG. 1I).

FIG. 1A clearly shows that the lid 4 has a skirt-shaped rim 30. The height of the skirt-shaped rim 30 increases continuously with its distance from the hinge 5. This results in the slope of the rim 30 as shown in FIG. 1B.

A spring arm 31 is provided within the chamber 12 for the purpose of keeping the lid 4 in an open position after it has been opened. Said spring arm may be in the form of a sprung blade. The spring arm 31 extends upwardly from the partition wall 13 at a constant distance from the rear wall 15. An abutting element 32 is provided on the lid 4. When the lid 4 is in the closed position, said abutting element is situated in the space formed between the spring arm 31 and the rear wall 15. This is also shown in detail in FIG. 1H. During the opening operation, the spring arm is resiliently deformed by the abutting element 32. On continuation of the opening operation, the spring arm 31 moves back toward the rear wall 15 over a short distance. With the lid 4 in the open position, the abutting element 32 is supported on the outer edge of the spring arm 31. This is shown particularly clearly in FIG. 1L. Additionally, in the course of injection molding, the spring arm 31 forms the injection point or, more specifically, the injection dome during the manufacture of the container closure 2. A slip-over bevel is provided at the upper end of the spring arm 31, enabling the abutting element to glide along the spring arm 31 while the lid 4 is being closed.

The container 1 and the container closure 2 may, in particular, be in the form of a plastics part. The production thereof is inexpensive when using an injection molding procedure. The lid and the element on the container body can be in the form of a single injection-molded part. Production takes place with the lid in the open position. It is advantageous when the lid 4 is closed in the injection mold when demolding to enable the child safety device to lock into place.

Figure 2A:
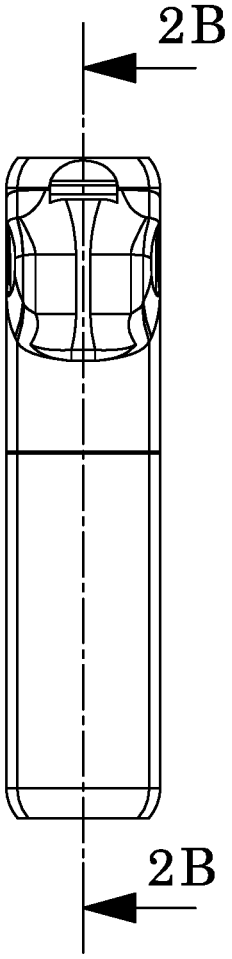
FIGS. 2A and 2B: show a second embodiment of the invention.
Figure 2B:
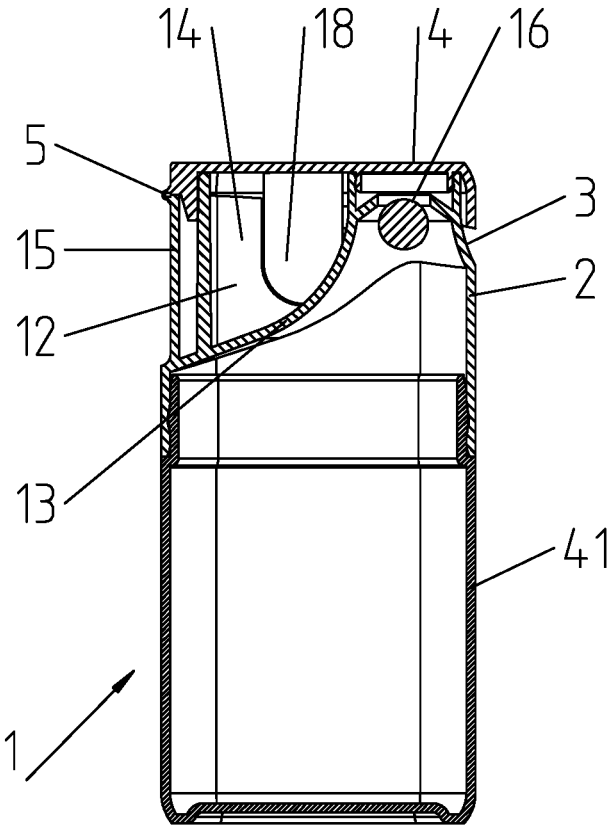

FIGS. 2A and 2B show a second embodiment of the invention. FIG. 2B is a longitudinal section of the container taken along the line 2B-2B in FIG. 2A. The design of the container closure 2 is equivalent to the design shown in FIGS. 1A to 1N. Reference is made thereto. However, FIGS. 2A and 2B show that the container closure 2 may be a separate part. As shown, the container 1 is designed as a container base part 41 separate from the container closure 2. As can be seen from FIGS. 2A and 2B, the two parts can be interconnected by plugging them together. The embodiment shown in FIGS. 2A and 2B does not require the provision of a base plug 24. The storage space 6 can be filled prior to attaching the container closure 2 to the separate container base part 41.

Figure 3C:
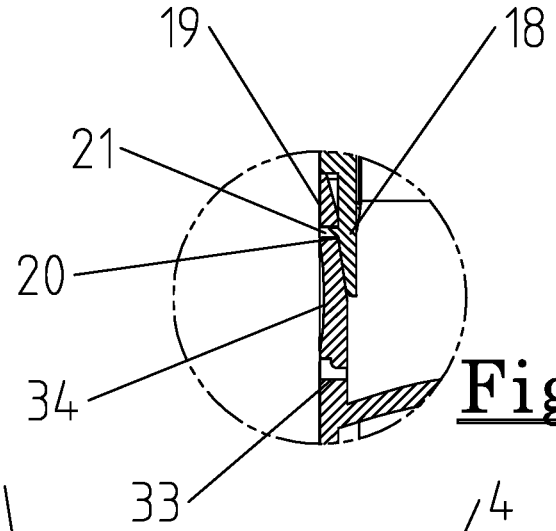
FIGS. 3A to 3F: show a third embodiment of the invention.
Figure 3A:
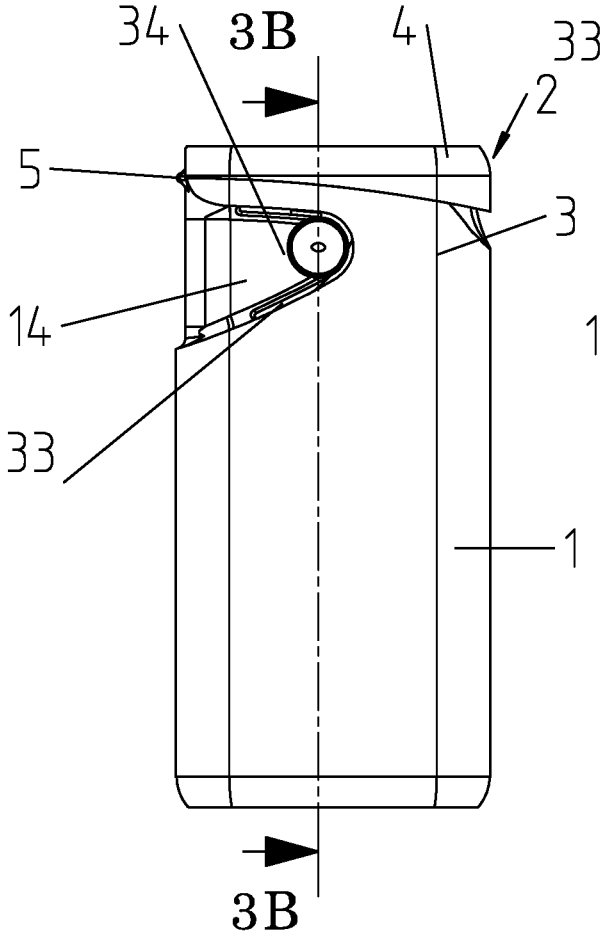
Figure 3B:
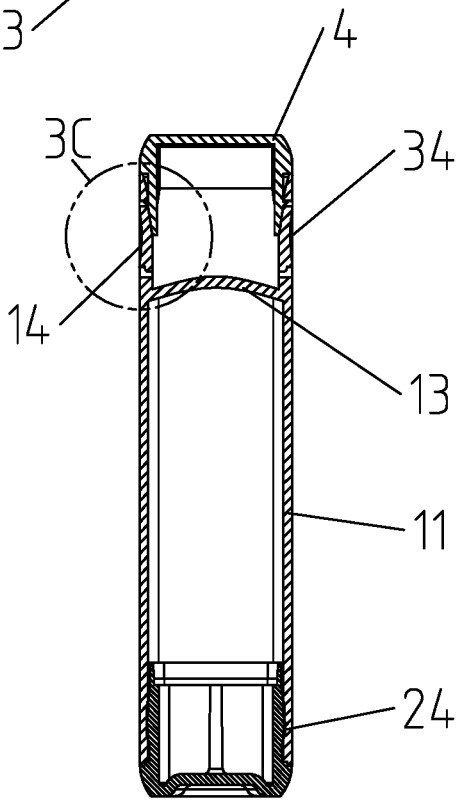
Figure 3D:
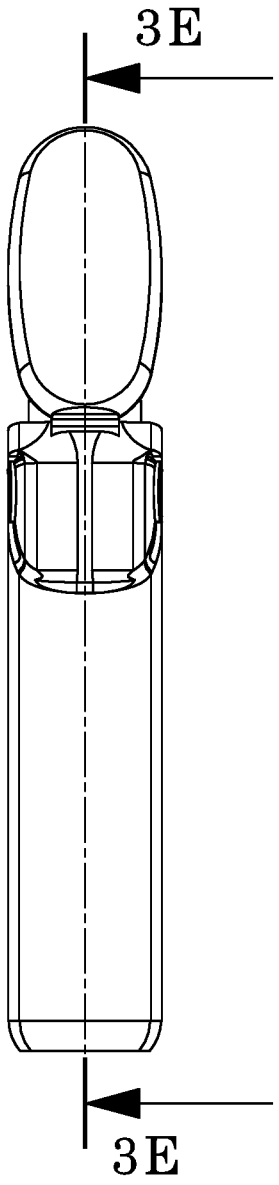
Figure 3E:
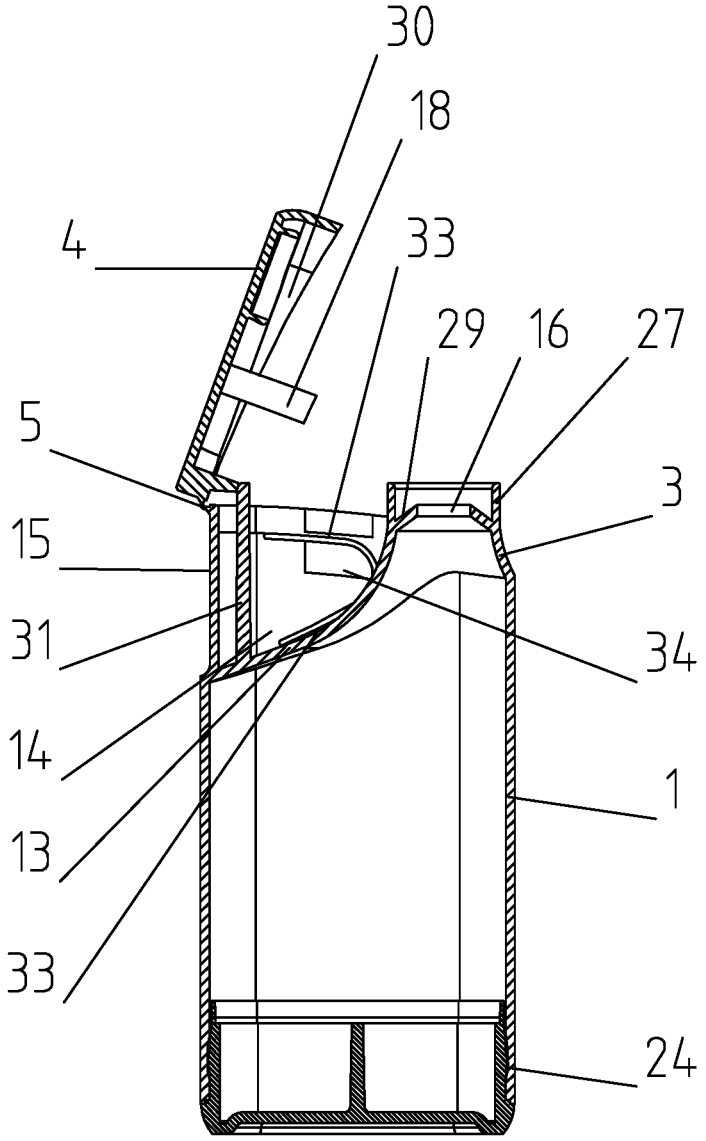
Figure 3F:
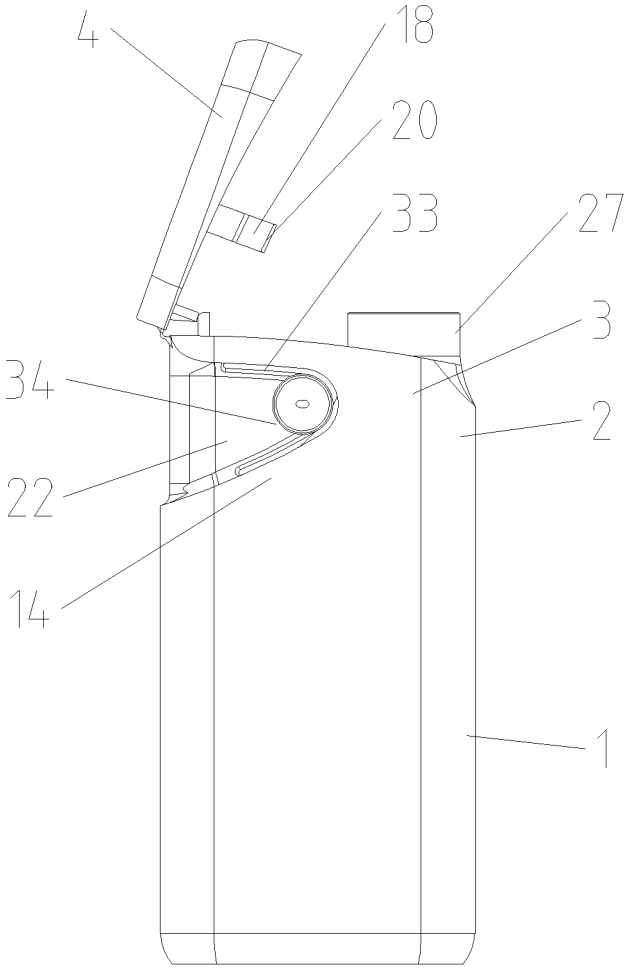

FIGS. 3A to 3F show a further embodiment of the invention. FIG. 3A is a side view of the container 1. FIG. 3B shows a cross section taken along the line 3B-3B pertaining to FIG. 3A. FIG. 3C shows an enlargement of the detail 3C shown in FIG. 3B. FIG. 3E is a longitudinal section of the container taken along the line 3E-3E with the lid in the open position taken from FIG. 3D. FIG. 3F is a side view of the container with the lid in the open position.

The container 1 and the container closure 2 shown in FIGS. 3A to 3F largely correspond to the embodiment described with reference to FIGS. 1A to 1N, to which reference is made herewith. However, an alternative configuration of the child safety device 7 is realized in FIGS. 3A to 3F.

The child safety device 7 comprises two clamping elements pertaining to the lid, and corresponding clamping elements 19 pertaining to the chamber. The clamping element 18 on the lid is in the form of a clamping flap. In the exemplary embodiment shown, two clamping flaps are provided on opposite sides of the lid 4. The clamping elements 18 on the lid have a projection 20, preferably of tapered design, on their outer surface. This is clearly visible in FIGS. 3B and 3C. The projection 20 interlocks with an opening 21 formed in the side wall 14 of the chamber 12. FIGS. 3B and 3C show the lid in its closed position, in which the child safety device is locked. The side wall 14 of the chamber 12 is resiliently movable. It can be moved inwardly on application of pressure. For the purpose of facilitating deformation of the side wall 14, a slit-shaped and roughly U-shaped opening 33 is provided in the side wall 14. In FIG. 3A, the open side of the "U" is directed toward the left. On account of the slit-shaped and roughly U-shaped opening 33, the deformation area 34 positioned therebetween and forming a resilient spring flap can be moved inwardly. While the deformation area 34 is being moved inwardly, the clamping element 18 on the lid is moved inwardly to an extent at which the projection 20 is moved out of the opening 21. In this position, the lid 4 can be opened and moved upwardly until it reaches the open position shown in FIG. 3F.

Figure 4E:
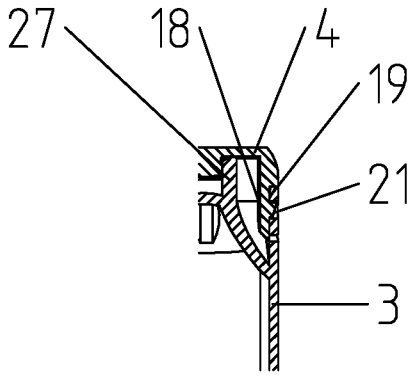
FIGS. 4A to 4G: show a fourth embodiment of the invention.
Figure 4D:
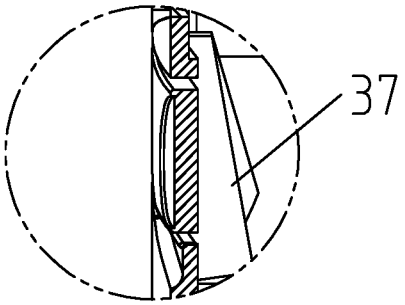
Figure 4A:
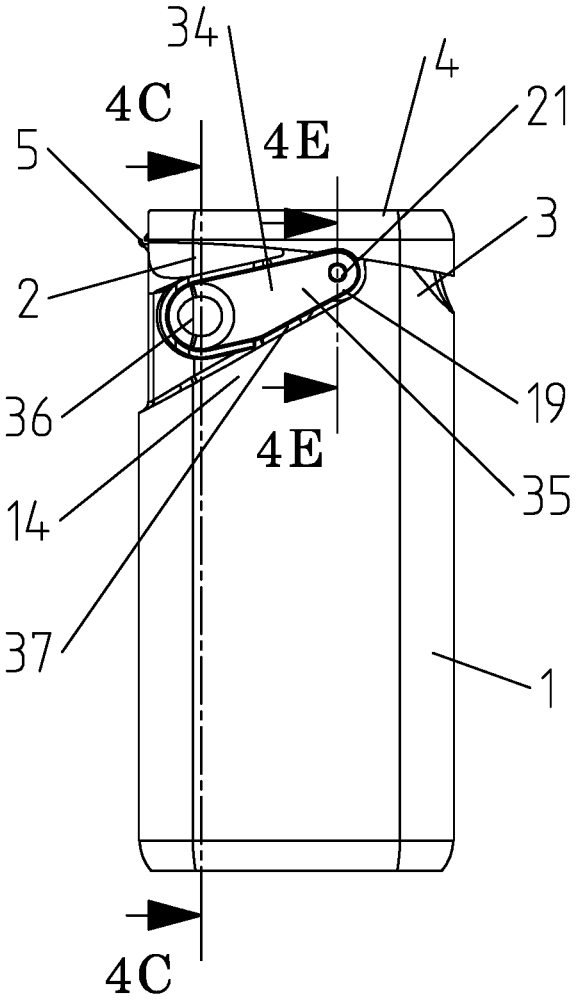
Figure 4C:
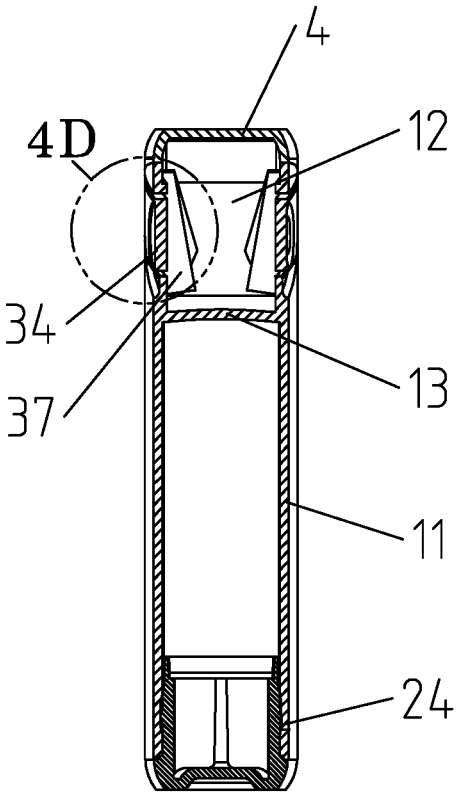
Figure 4B:
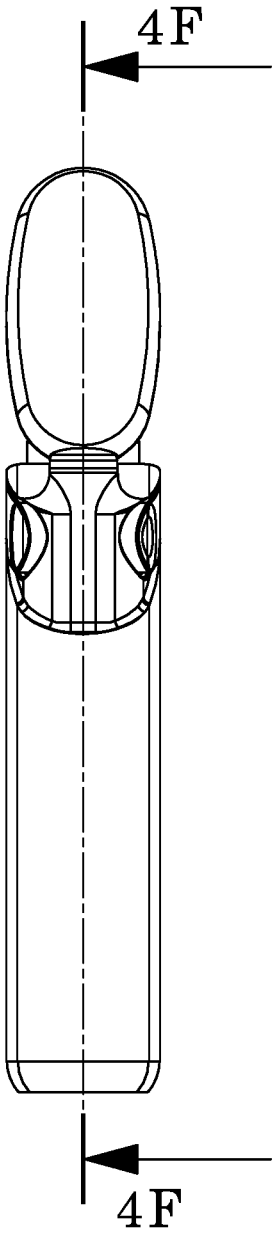
Figure 4F:
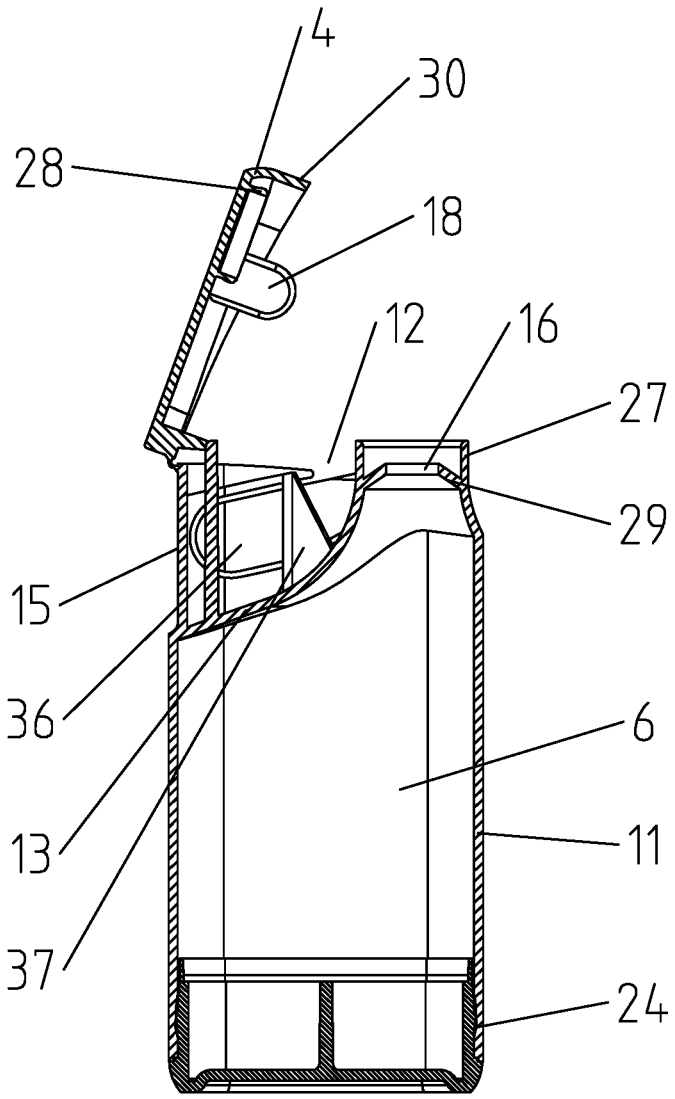
Figure 4G:
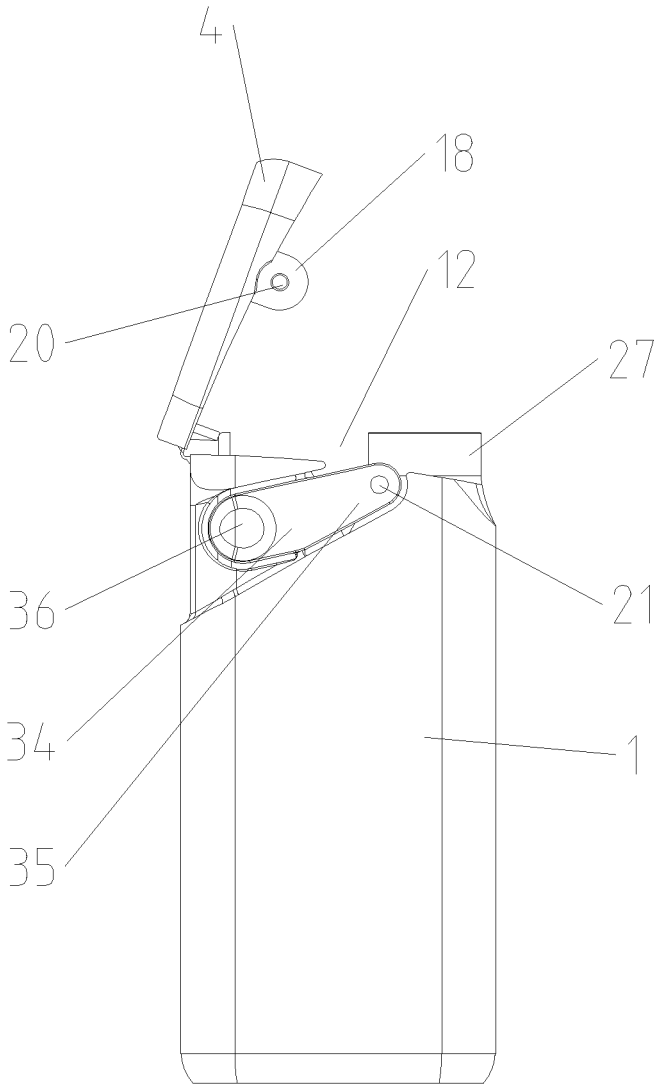

FIGS. 4A to 4G show a further embodiment of the invention. FIG. 4A is a side view of the container. FIG. 4F is a longitudinal section taken along the line 4F-4F of the container of FIG. 4B with the lid in an open position. FIG. 4C shows a cross section taken along the line 4C-4C pertaining to FIG. 4A. The detail 4D pertaining to FIG. 4C is shown enlarged in FIG. 4D. FIG. 4E shows a portion of a cross section taken along the line 4E-4E pertaining to FIG. 4A. FIG. 4G is a side view with the lid 4 in an open position.

The container 1 and the container closure 2 shown largely correspond to the embodiments described above (in particular in FIGS. 1A to 1N), to which reference is made herewith. However, an alternative design of the child safety device 7 is realized in FIGS. 4A to 4G.

The child safety device 7 shown in FIGS. 4A to 4G again comprises two clamping elements 18 disposed on the lid 4. This is shown particularly clearly in FIGS. 4F and 4G. The clamping elements 18 pertaining to the lid again comprise a projecting section 20 (projection), which is in the form of a knob. The clamping element 19 pertaining to the chamber 12 is on the other hand provided in the side wall 14. Said side wall comprises an opening 21 encompassing the projection 20 when the lid is in the closed position. The form fit thus achieved prevents the lid 4 from being opened by children. This is shown particularly clearly in the enlarged illustration in FIG. 4E. A deformation area 34 is formed in the side wall 14 by way of a slit-shaped opening. The deformation area 34 is in the form of a lever, the opening 21 being provided in one lever arm 35 thereof. The other lever arm 36 forms a gripping surface, which is circular in the exemplary embodiment shown. The second lever arm can be moved inwardly into the chamber 12 by applying pressure to the gripping surface of the second lever arm 36. As a result, the first lever arm 35 is moved outwardly until the opening 21 releases the projecting section 20 of the clamping elements 18 on the lid. The movability of the deformation area 34 in the manner of a lever is achieved by the provision of a rib-shaped element 37 in a central area of the deformation area 34, forming a type of pivot bearing for the first and second lever arms 35, 36.

Figure 5E:
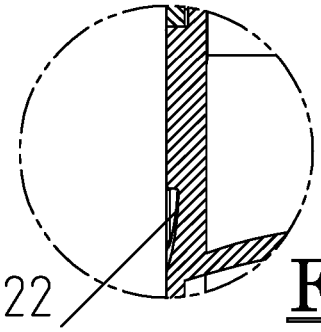
FIGS. 5A to 5F: show a fifth embodiment of the invention.
Figure 5A:
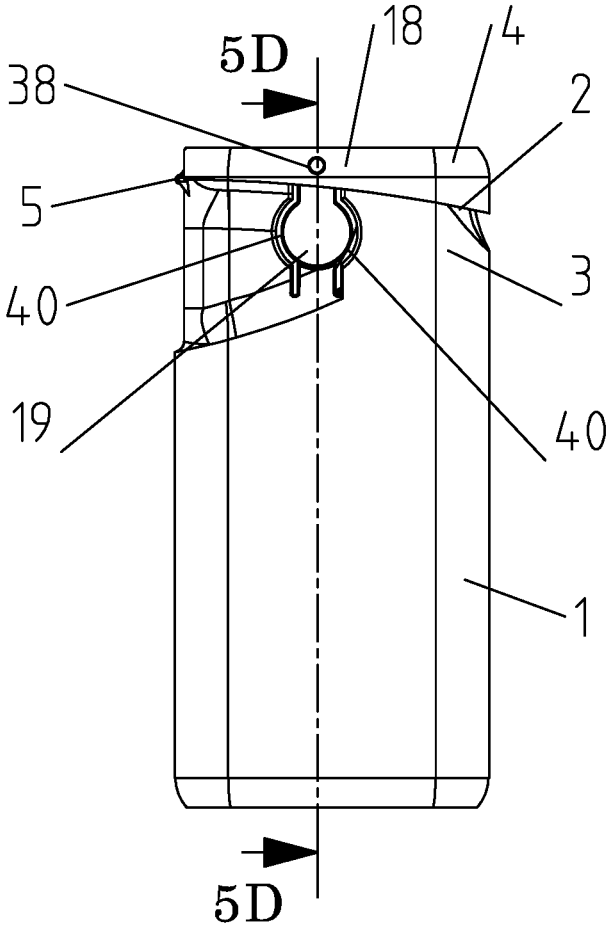
Figure 5D:
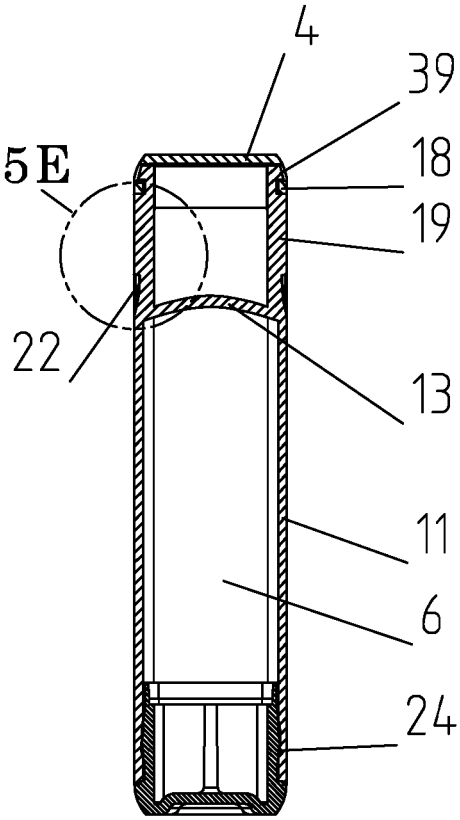
Figure 5B:
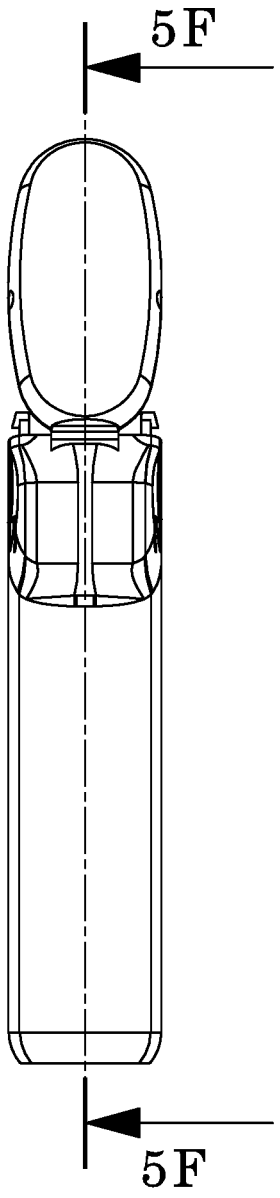
Figure 5F:
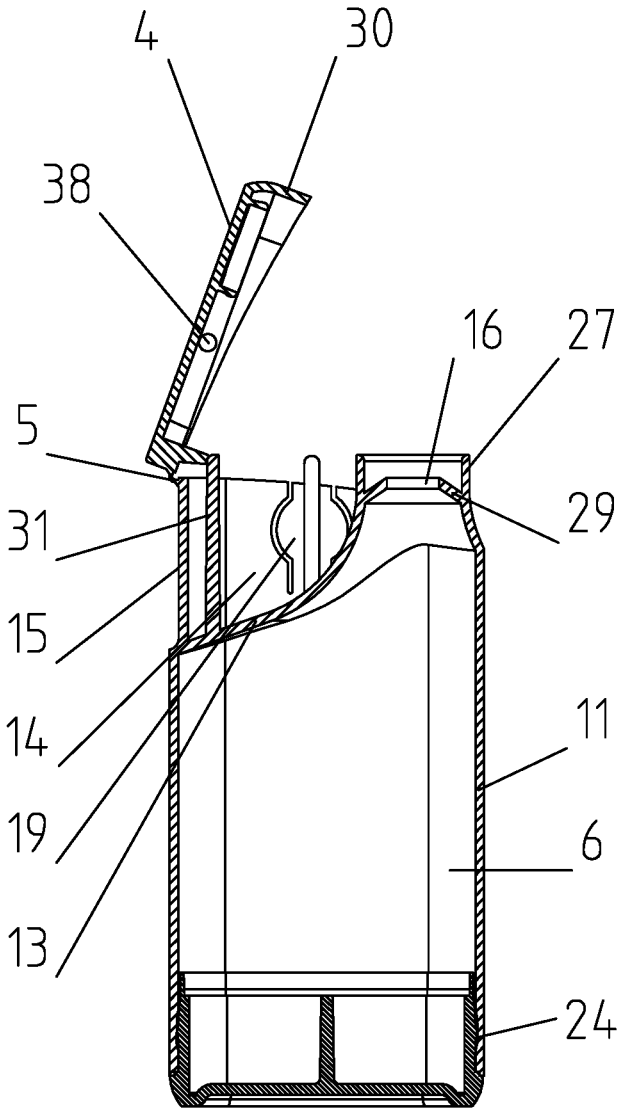
Figure 5C:
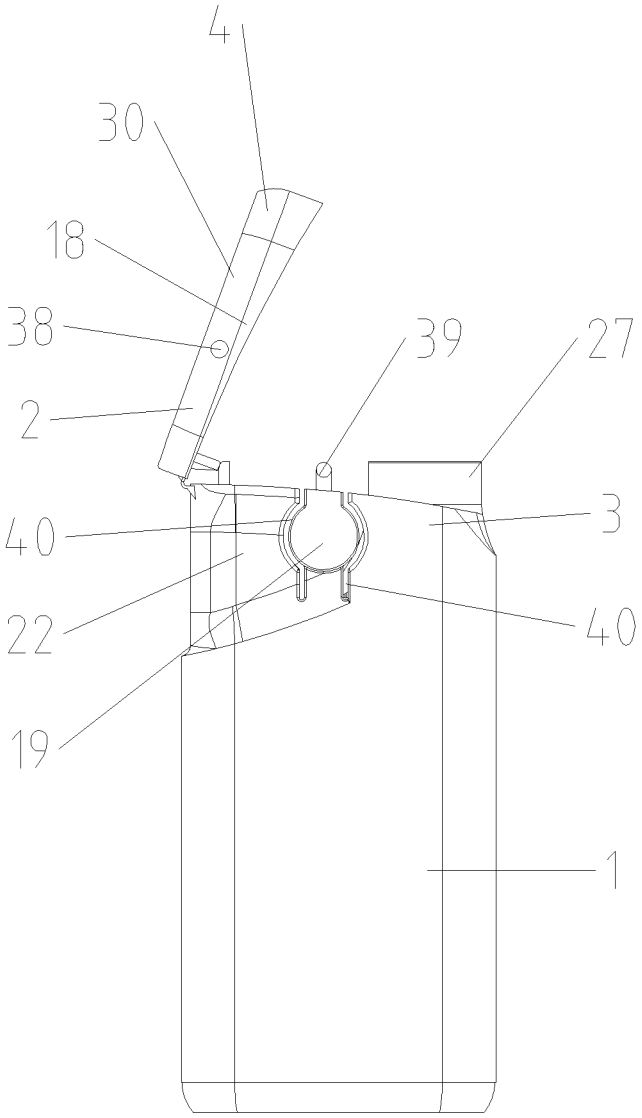

FIGS. 5A to 5F show a further embodiment of the invention. The container 1 and the container closure 2 largely correspond to the embodiments described above (see in particular FIGS. 1A to 1N), to which reference is made herewith. However, an alternative design of the child safety device 7 is realized according to FIGS. 5A to 5F. FIG. 5A is a side view of the container of the invention with the lid in the closed position. FIG. 5F shows the same container in longitudinal section with the lid in the open position. FIGS. 5C and 5F are a side view of the container pertaining to FIG. 5B. FIG. 5D shows a cross section taken along the line 5D-5D in FIG. 5A. FIG. 5E shows the enlarged detail 5E displayed in FIG. 5D. FIG. 5F is a longitudinal section of the container taken along the line 5F-5F of FIG. 5B.

In the embodiment shown in FIGS. 5A to 5F, the child safety device 7 comprises a clamping element 18 pertaining to the lid. Said clamping element is formed by an opening 38 on the lid, disposed on the skirt-shaped rim 30. In the exemplary embodiment shown, an opening 38 on the lid is provided on each of the opposite sides of the lid 4. The clamping element 19 pertaining to the chamber is formed by a part of the side wall 14. In the exemplary embodiment shown, the clamping element 19 of the chamber is in the form of a resiliently movable clamping flap directed toward the lid 4. The clamping flap comprises a projection 39, which is in the form of a knob in the present exemplary embodiment. With the lid 4 in the closed position, the projection 39 locks into place in the opening 38 in the lid. The form fit thus created prevents undesired opening of the lid 4.

The clamping element 19 of the chamber is formed by two slit-shaped openings 40 in the side wall 14. A resiliently movable flap is thus formed. The child safety device can be unlocked by simultaneously applying inward pressure to the clamping elements 19 of the chamber. As long as the clamping elements 19 are held in the above position, the lid can be moved upwardly and thus opened.

Figure 6A:
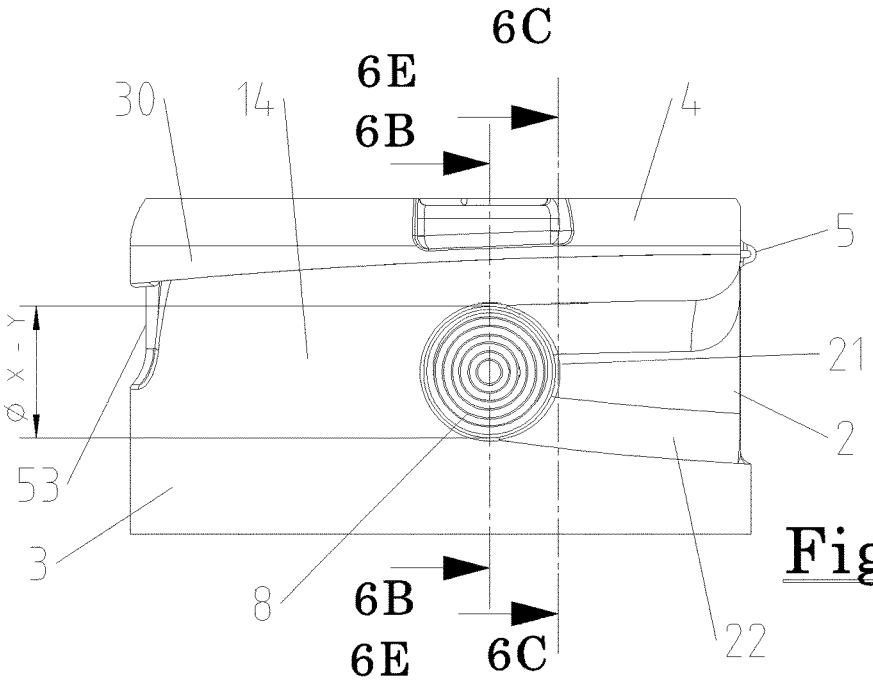
FIGS. 6A to 6O: show a sixth embodiment of the invention.
Figure 6B:
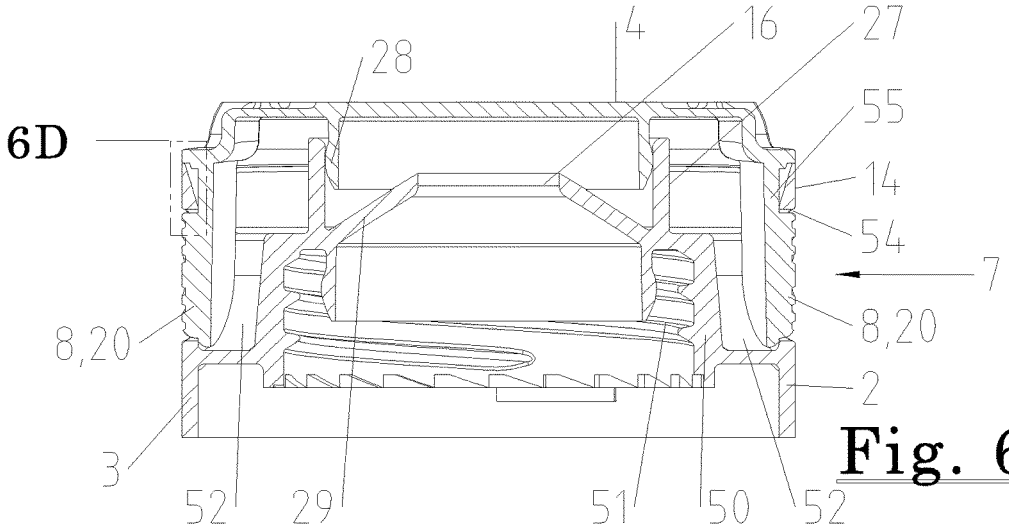
Figure 6C:
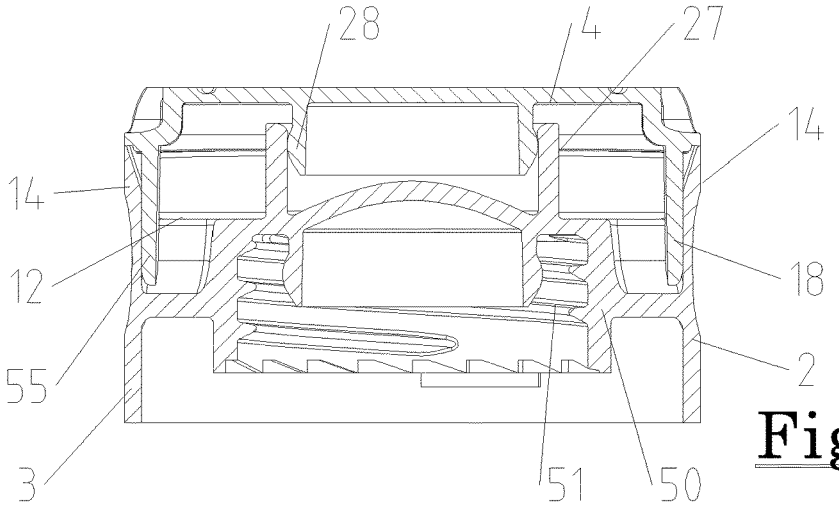
Figure 6F:
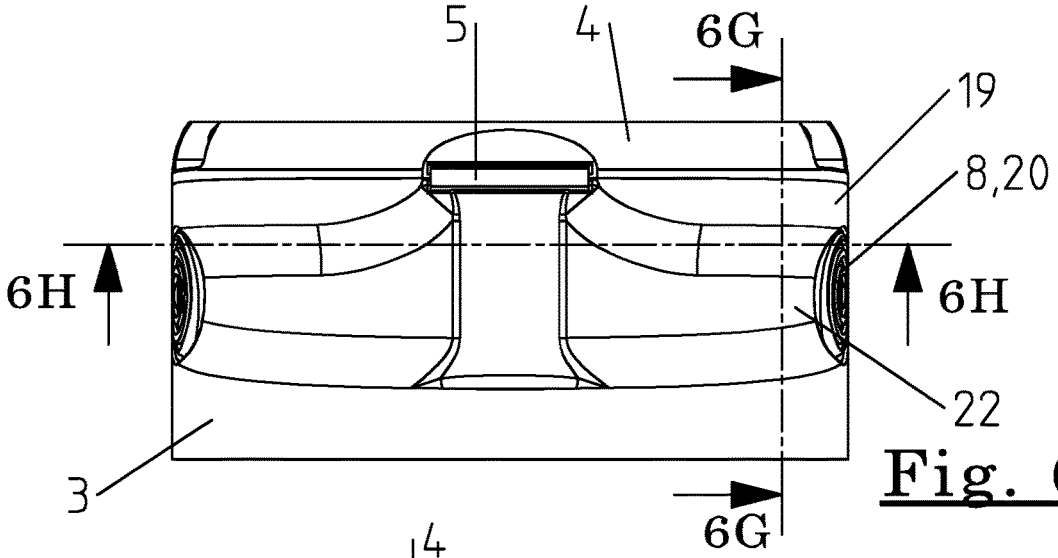
Figure 6G:
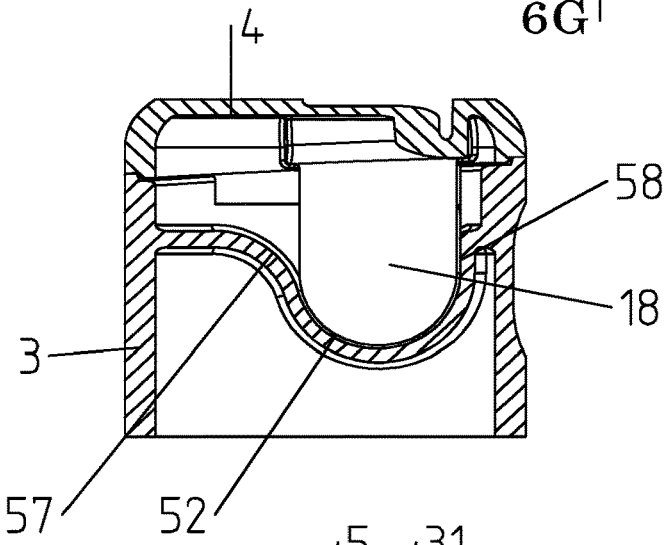
Figure 6H:
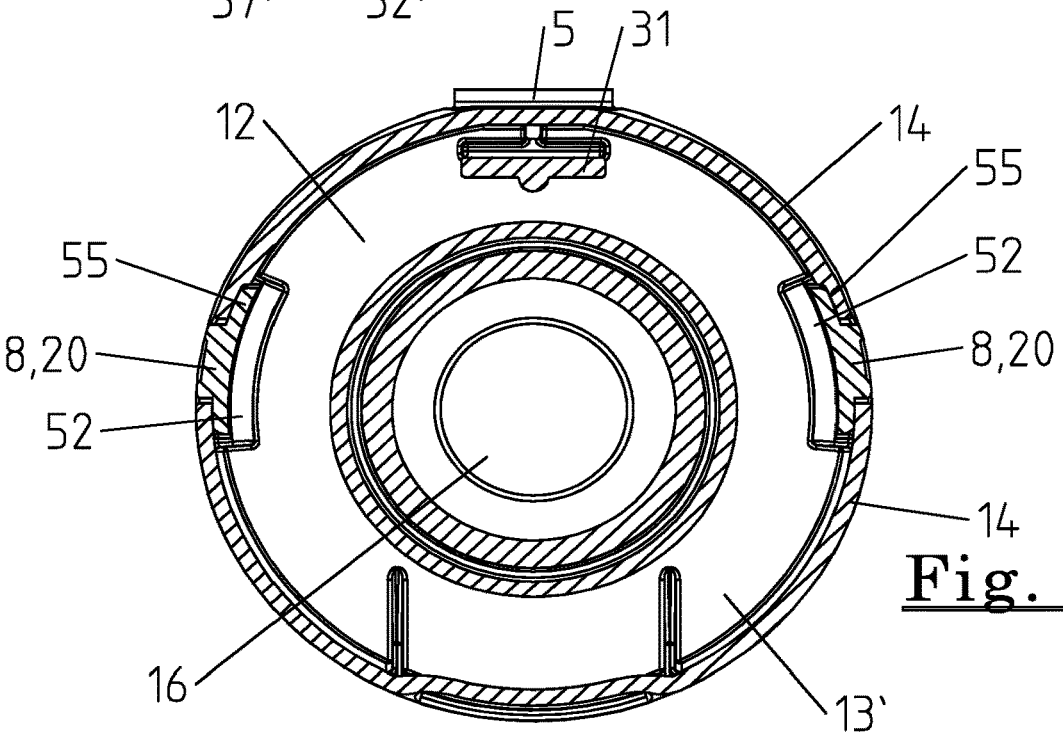
Figure 6I:
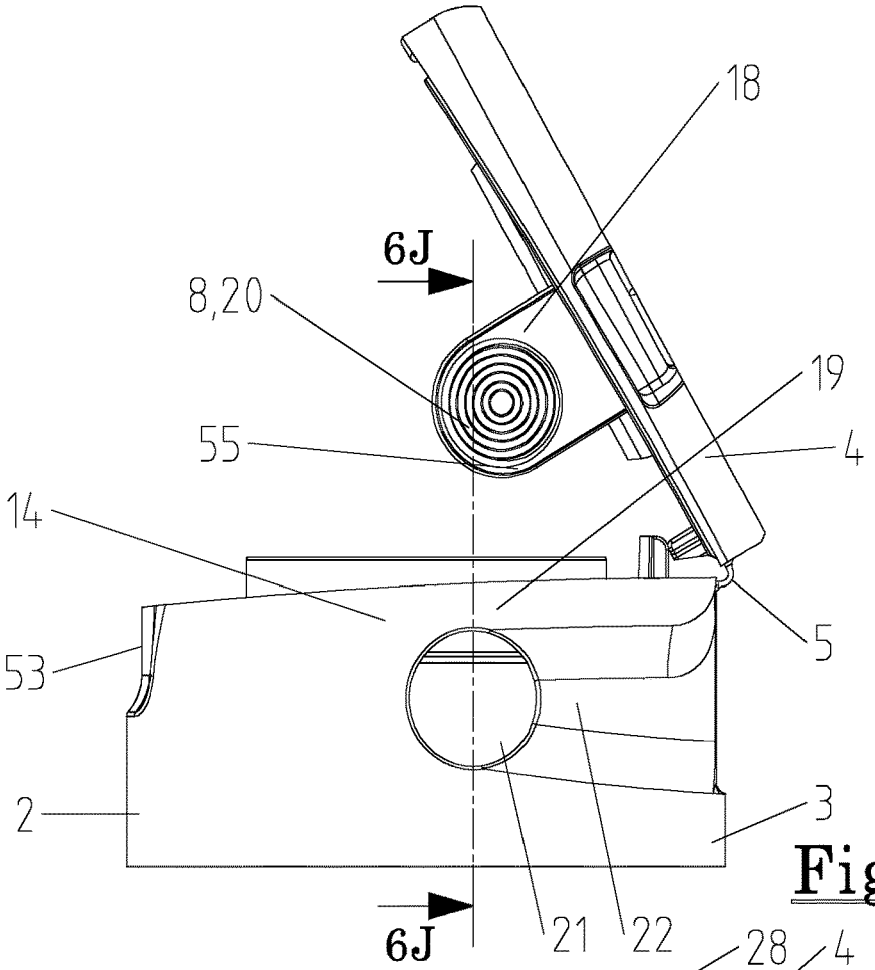
Figure 6J:
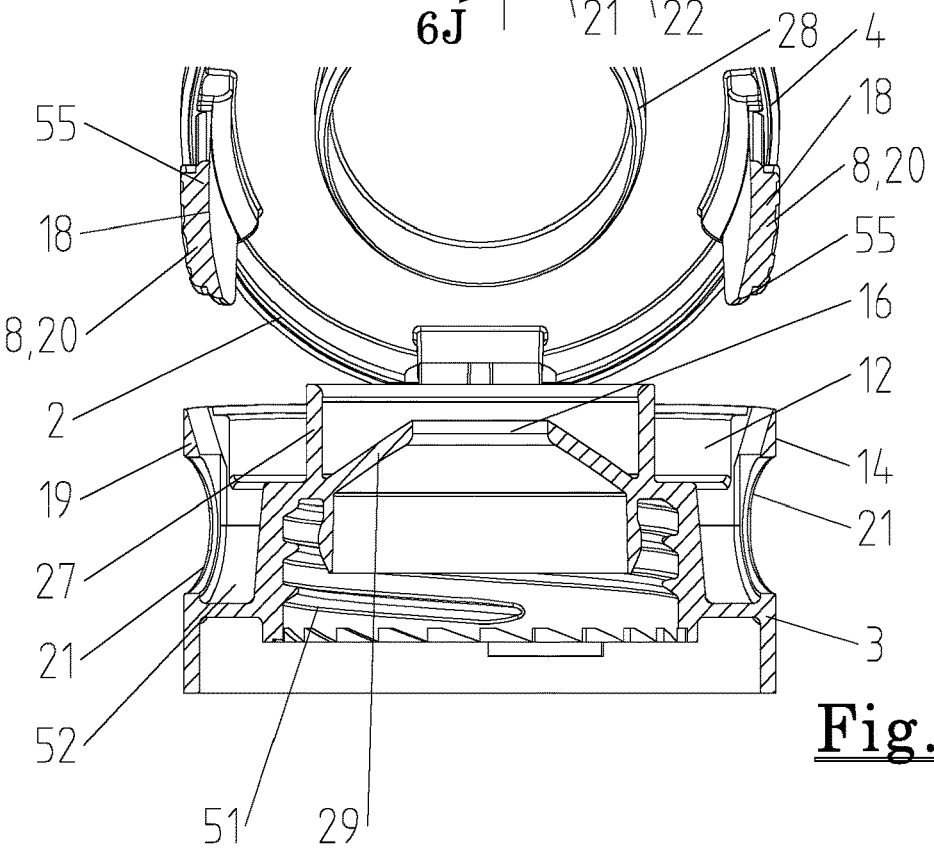
Figure 6M:
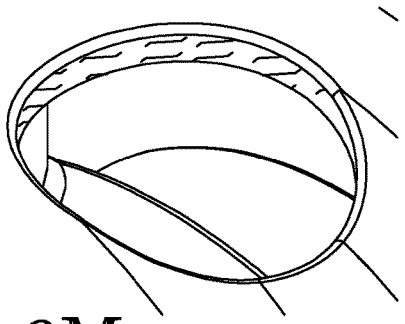
Figure 6L:
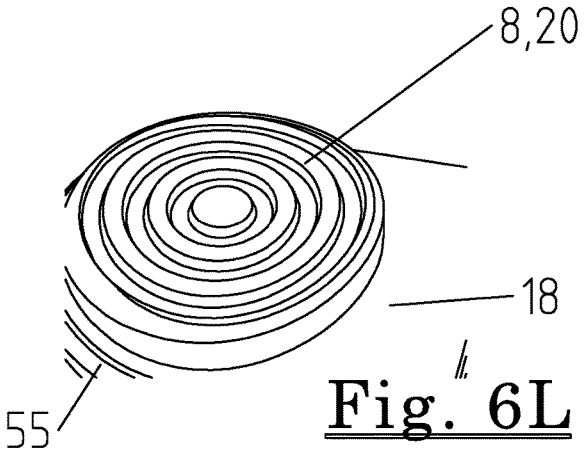
Figure 6K:
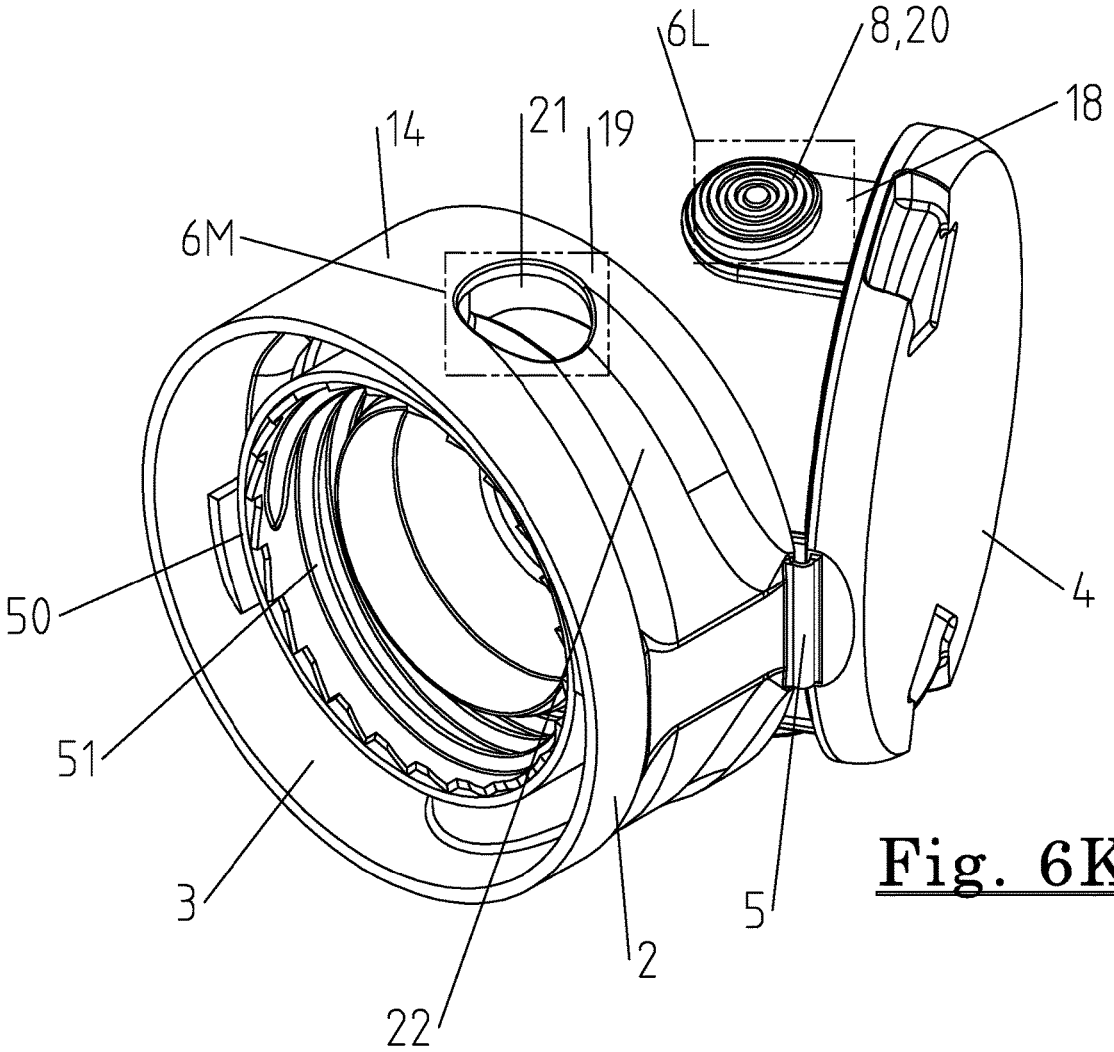
Figure 6N:
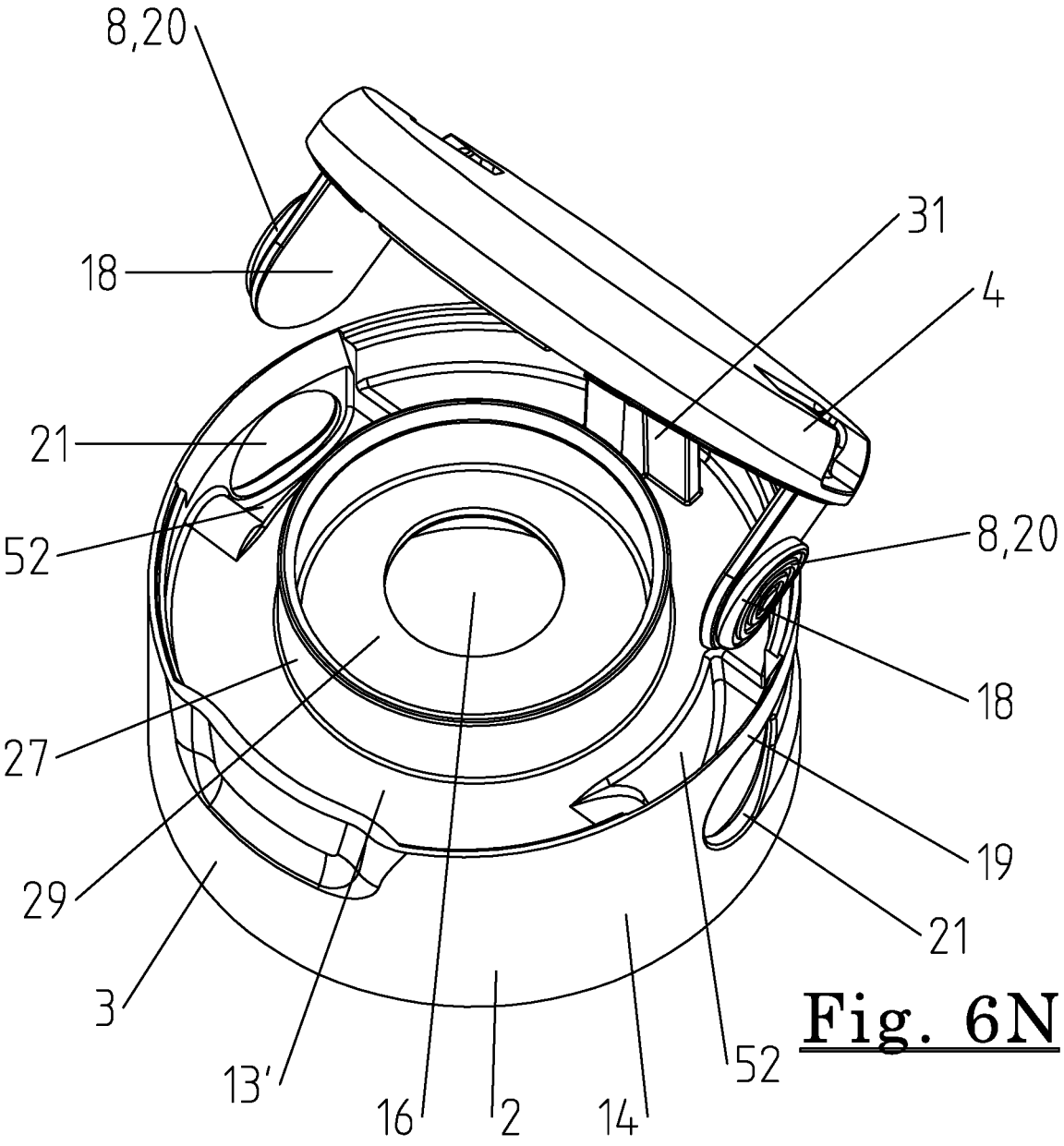

FIGS. 6A to 6O show a further embodiment of the invention. FIG. 6A is a side view of the container closure 2. FIG. 6B is a cross section of the container closure 2 depicted in FIG. 6A taken along the line 6B-6B, while FIG. 6C is a cross section taken along the line 6C-6C. FIG. 6D shows an enlarged detail 6D of the container closure 2 pertaining to FIG. 6B. FIGS. 6E and 6O show an alternative design of the detail pertaining to FIG. 6B with FIG. 6O showing enlarged detail 6O of the container closure 2 pertaining to FIG. 6E. FIG. 6F is a side view, rotated through 90°, of the container closure 2 pertaining to FIG. 6A, showing the hinge 5. FIG. 6G is a cross section, taken along the line 6G-6G, of the container closure 2 pertaining to FIG. 6F. FIG. 6H is a cross section, taken along the line 6H-6H, of the container closure 2 pertaining to FIG. 6F. FIG. 6I is a side view of the container closure 2 pertaining to FIG. 6A with the lid in the open position. FIG. 6J is a partial cross section, taken along the line 6J-6J; of the container closure 2 pertaining to FIG. 6I. FIG. 6K is a perspective view of the container closure 2 pertaining to FIG. 6A taken from below, with the lid 4 in the open position. FIGS. 6L and 6M show enlarged details of the container closure 2 pertaining to FIG. 6K. FIG. 6N is a perspective view of the container closure pertaining to FIG. 6A taken from above, with the lid 4 in the open position.

The design of the container closure 2 shown in FIGS. 6A to 6O largely corresponds to the design shown in the other figures. In order to avoid repetition, reference is made to the description thereof that is relevant to FIGS. 6A to 6O.

FIGS. 6A to 6O show a container closure 2 manufactured as a separate entity. The container closure 2 comprises a linking part 50 for the purpose of connecting it to a container (not shown). Said part is provided with a female thread 51. The container closure 2 can be screwed via the female thread 51 onto a container provided with an appropriate male thread. The linking part may be of different design, depending on the embodiment of the container required.

It can also be seen that the container closure 2 comprises a child safety device 7 largely corresponding to that pertaining to the first exemplary embodiment as shown in FIGS. 1A to 1N.

Contrary to the first exemplary embodiment, the container closure 2 is circular in cross section (see especially FIG. 6H). This relates to both section 3 pertaining to the container and the lid 4, which are interconnected via the hinge 5. In the present exemplary embodiment, the discharge opening 16 is disposed in the center. The chamber 12 extends over a region ranging from the discharge opening 16 to the hinge 5. Furthermore, the chamber 12 also extends to that side of the opening 16 which is remote from the hinge 5. In the present case, the chamber 12 is of an annular shape and extends around the opening 16. The chamber 12 is separated from the storage space. For this purpose, a partition wall 13 is provided that delimits the chamber 12 on its side facing the container.

Recessed areas 52 are provided inside the chamber 12 for the purpose of accommodating the clamping element 18 when the lid 4 is in the closed position. The chamber 12 is surrounded by a circumferential side wall 14 of the chamber. Said side wall is cylinder-shaped and surrounds the opening 16 at a distance therefrom. A part of the side wall 14 forms the clamping element 19 of the chamber. To this end, an opening 21 is disposed in the side wall 14 for each clamping element 18 pertaining to the lid. The openings 21 are disposed opposite each other to facilitate the operation of the thrust faces of the projections 20 by means of two fingers of one hand, more particularly by the thumb and index finger thereof. When the lid 4 is closed, the clamping elements 18 on the lid engage the opening 21 by means of their respective projection 20. In this regard, the openings 21 are disposed at an offset angle of about 80° from the hinge 5.

The lid 4 can be opened and closed repeatedly for the purpose of removing contents from the container.

Additionally, the container closure 2 comprises a recessed grip 53 facilitating lifting of the lid 4.

The arrangement of the projections 20 in the openings 21 as well as the receding region 22 of the side wall 14 can be seen particularly clearly in FIG. 6A. It is further shown that a small annular gap 54 is provided between the projection 20 and the opening 21 (see FIG. 6B). To prevent debris from entering the chamber 12, the annular gap 54 is closed in that an extended section 55 of the clamping element 18 adjoins the projection 20 so as to cover and thus close the annular gap 54 (see FIG. 6L). This is also clearly shown in FIG. 6C, which is a cross section of the extended section 55 at the edge of the projection 20.

FIGS. 6B and 6C clearly show the female thread 51 and the arrangement of the opening 16. Also shown is the sealing part 28, of the same design as shown in the first embodiment.

FIG. 6D shows an enlarged detail pertaining to FIG. 6B. Also see alternative embodiment in FIGS. 6O and 6E. The manner in which the clamping element 18 pertaining to the lid interlocks with the clamping element 19 pertaining to the chamber is clearly shown. The projection 20 is enclosed by the opening 21. By simultaneously applying pressure to the projections 20 in an inward direction, these can be moved inwardly until the clamping element 18 pertaining to the lid is released for movement to the opened position as shown in FIG. 6I.

FIGS. 6E and 6O show an alternative design of this detail. It is depicted that the actuating section 8 comprises a protruding edge 56, which interlocks with the clamping element 19 of the chamber. The protruding edge 56 engages an undercut at the edge of the opening 21 from behind. Accordingly, the edge of the side wall 14 facing the projection 20 has an inclined surface. A similarly inclined surface is also provided on the clamping element 18 at the side of the projection 20. When the lid 4 is pushed up without releasing the child safety device 7, the clamping elements 18 and 19 become wedged, thus impeding undesired opening. In other respects, the clamping elements 18 and 19 are of the same design as the clamping elements of the embodiment as shown in FIGS. 1A to 1D and 1F to 1N.

FIG. 6F is a side view of the container closure 2, viewing the hinge 5. The receding region 22 of the side wall 14 is clearly shown, as well as the fact that the projection 20 protrudes outwardly relatively to the receding region 22.

FIG. 6G clearly shows the design of the recessed area 52. It is depicted that the recessed area 52 is U-shaped. A rounded transition 57 is provided on the side remote from the hinge 5. The side of the recessed area facing the hinge 5 forms a contact surface 58 for the clamping element 18.

FIG. 6H shows the construction of the container closure 2 as a cross section taken along the line 6H-6H in FIG. 6F. Here, the flush contact surface between the extended section 55 of the clamping element 18 and the side wall 14 is clearly visible.

FIGS. 6I to 6K and 6N show the container closure 2 with the lid 4 in the open position. The extended section 55 present on the projection 20 is again clearly visible. The projection 20 thus has a stepped configuration.

FIGS. 6L and 6M are enlarged views of the projection 20 of the clamping elements 18 on the lid, and the opening 21 in the side wall 14 shown in FIG. 6K. FIG. 6L clearly shows the projection 20 is of a circular design and forms a thrust face consisting of annular ribs. FIG. 6M shows the design of the opening 21.

Figure 7A:
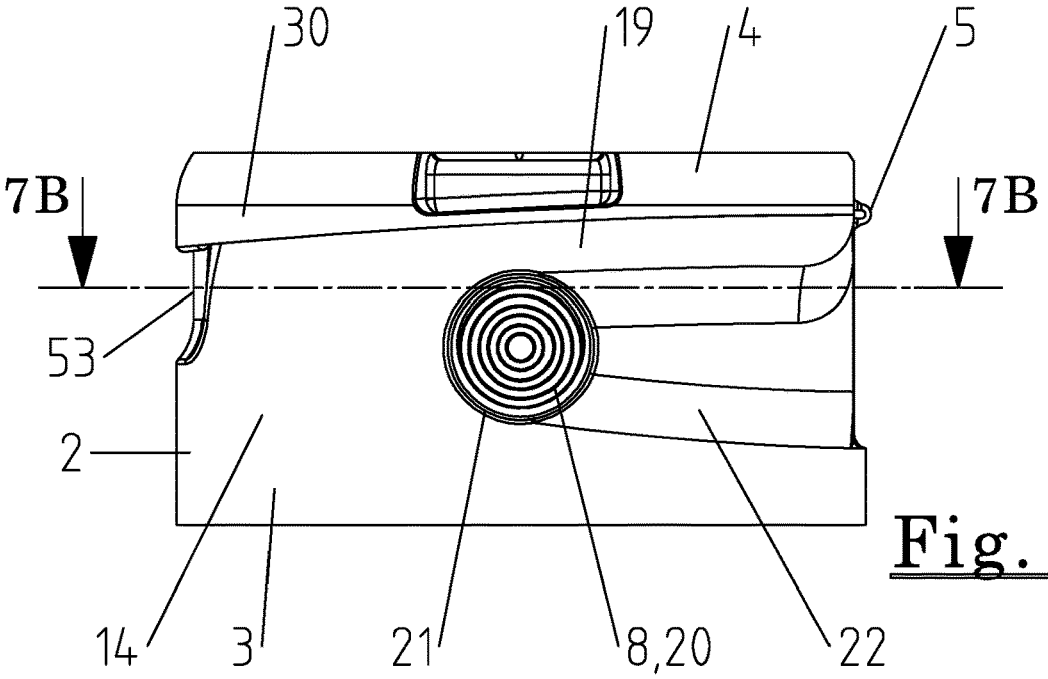
FIGS. 7A and 7B: show a first variant of the sixth embodiment.
Figure 7B:
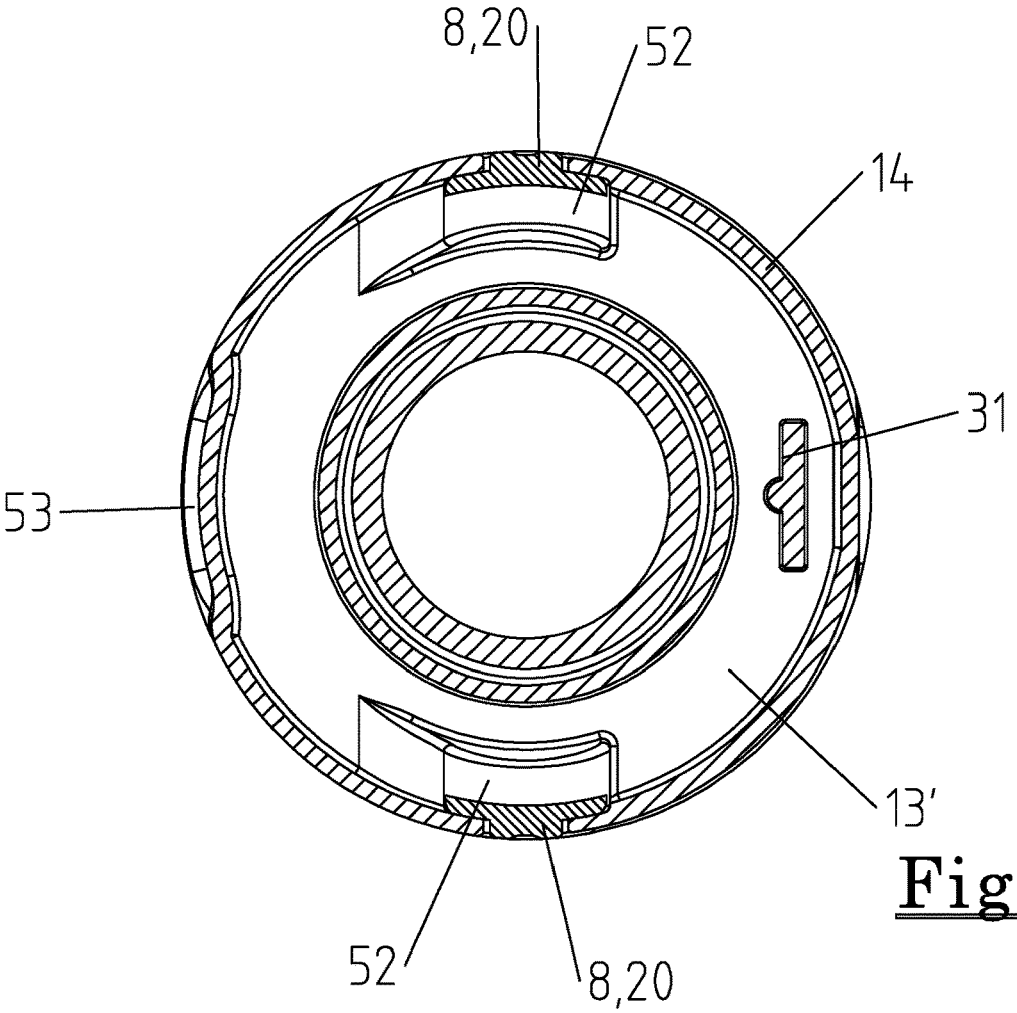
Figure 8A:
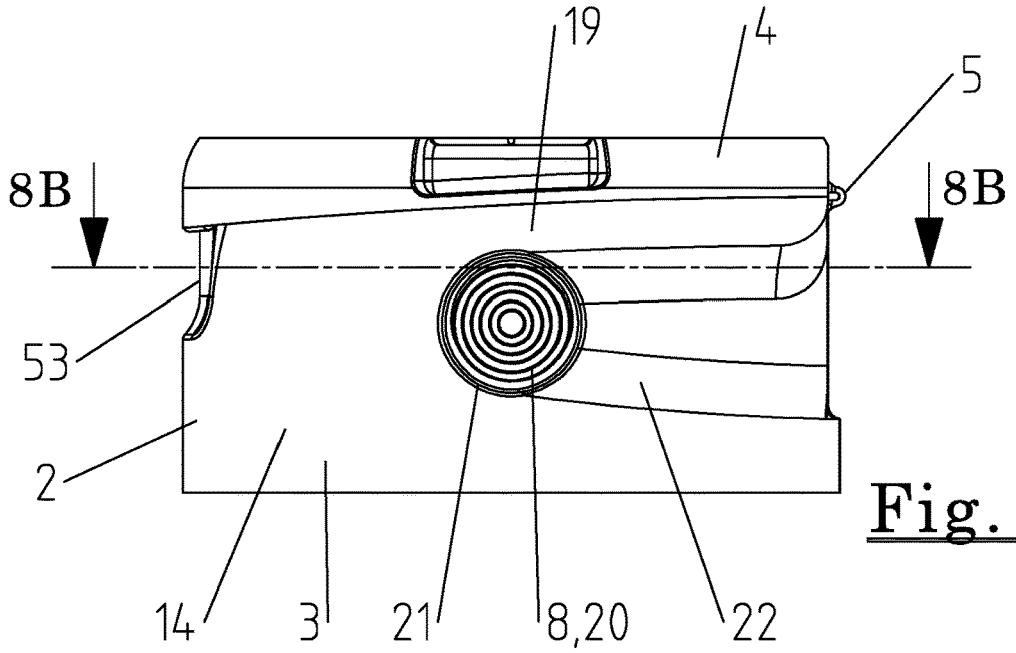
FIGS. 8A and 8B: show a second variant of the sixth embodiment.
Figure 8B:
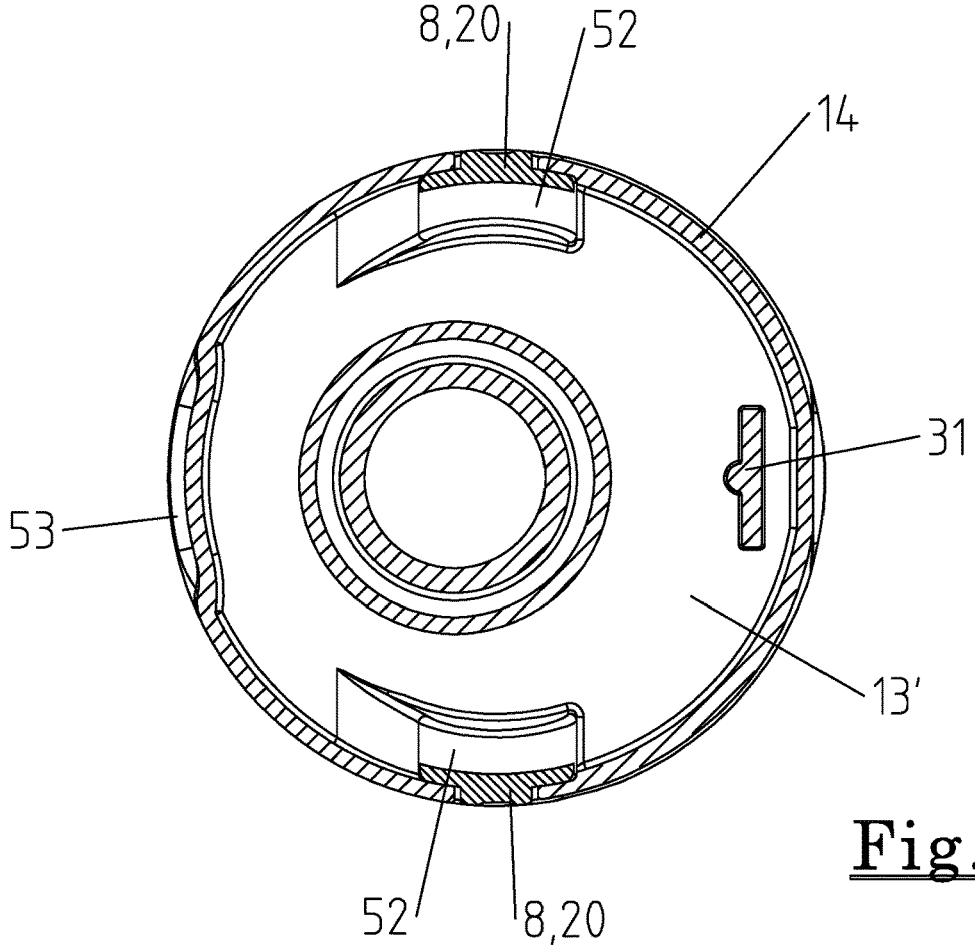

FIGS. 7 and 8 show two variants of the container closure described with reference to FIGS. 6A to 6O. FIGS. 7A and 8A each show a side view of the container closure. FIGS. 7B and 8B are in each case a cross section taken along the line 7B-7B in FIG. 7A and 8B-8B in FIG. 8A respectively. FIGS. 7A and 7B show that the opening 21 and the projection 20 are disposed at an angle of approximately 90° relatively to the hinge 5. In FIGS. 8A and 8B, the discharge opening 16 is eccentrically positioned. In both cases, the chamber 12 can surround the discharge opening 16, as shown.

The invention claimed is:

1. A container closure for a container having a storage space for accommodating goods to be packaged, said container closure comprising:

a closure part adapted to be connectable to a container, said closure part comprising a chamber separated from a discharge chute by a partition wall, wherein said partition wall is configured to separate said chamber from the storage space, said chamber having an annular wall projecting away from said partition wall and having an upper portion and a lower portion, wherein the lower portion of said annular wall is connected to said partition wall, a first pair of opposing clamping elements, each one of said first pair of clamping elements being disposed in said annular wall, said discharge chute including a discharge opening operatively allowing removal of the goods to be packaged;

a lid connected to said closure part by a hinge, wherein said hinge connects to the lid on the upper portion of said annular wall, said lid having a second pair of clamping elements projecting from a bottom of said lid, each one of said second pair of clamping elements being operably spaced from each other, each one of said second pair of clamping elements corresponding to one of said first pair of clamping elements in said chamber, wherein when in a closed position said lid is in contact with said upper portion of said annular wall;

wherein said discharge chute includes a tubular portion and a limiting element, wherein said limiting element extends radially inward from the tubular portion, wherein said limiting element extends upwardly at an angle towards the lid when the lid is in the closed position, wherein said lid further comprises an annular sealing part extending inwardly from an inner surface of the lid, wherein said sealing part is in sealing contact with the tubular portion when the lid is in the closed position; and a child safety device disposed in said chamber at least when said lid is in the closed position, said child safety device comprising said second pair of clamping elements and said first pair of clamping elements, said child safety device being activated at least when said lid is urged into the closed position wherein said second pair of clamping elements slide along said annular wall to engage said first pair of clamping elements, wherein said second pair of clamping elements are inwardly actuatable to unlock and open said lid.

* * * * *